US010546467B1

(12) United States Patent
Luciano, Jr. et al.

(10) Patent No.: US 10,546,467 B1
(45) Date of Patent: Jan. 28, 2020

(54) DUAL MATRIX TRACKING SYSTEM AND METHOD

(71) Applicants: Robert A. Luciano, Jr., Reno, NV (US); Warren R. White, Reno, NV (US)

(72) Inventors: Robert A. Luciano, Jr., Reno, NV (US); Warren R. White, Reno, NV (US)

(73) Assignee: EDGE TECHNOLOGY, Reno, NV (US)

( * ) Notice: Subject to any disclaimer, the term of this patent is extended or adjusted under 35 U.S.C. 154(b) by 8 days.

(21) Appl. No.: 15/707,361

(22) Filed: Sep. 18, 2017

(51) Int. Cl.

| | |
|---|---|
| ***G07F 17/38*** | (2006.01) |
| ***A63B 43/00*** | (2006.01) |
| ***A63B 67/02*** | (2006.01) |
| ***G07F 17/32*** | (2006.01) |
| ***A63B 24/00*** | (2006.01) |

(52) U.S. Cl.
CPC ..... *G07F 17/38* (2013.01); *A63B 24/0021* (2013.01); *A63B 43/004* (2013.01); *A63B 67/02* (2013.01); *G07F 17/3295* (2013.01); *A63B 2024/0034* (2013.01); *A63B 2024/0053* (2013.01); *A63B 2220/20* (2013.01); *A63B 2220/62* (2013.01); *A63B 2220/805* (2013.01); *A63B 2225/54* (2013.01)

(58) Field of Classification Search
CPC ..... A63B 2024/0034; A63B 67/02; A63B 43/004; A63B 2220/805; A63B 2220/62; A63B 2220/20; A63B 225/54; A63B 2024/0053; G07F 17/32; G07F 17/3267; G07F 17/3295
See application file for complete search history.

(56) References Cited

U.S. PATENT DOCUMENTS

| | | | | | |
|---|---|---|---|---|---|
| 3,558,140 | A * | 1/1971 | Romeo | A63B 69/36 | 273/396 |
| 5,333,874 | A * | 8/1994 | Arnold | A63B 24/0021 | 473/156 |
| 5,553,846 | A * | 9/1996 | Frye | A63B 24/0021 | 473/215 |
| 5,846,139 | A * | 12/1998 | Bair | A63B 24/0021 | 473/156 |
| 2001/0056000 | A1* | 12/2001 | Hori | A63B 63/00 | 473/453 |
| 2006/0040735 | A1* | 2/2006 | Baerlocher | G07F 17/32 | 463/26 |

* cited by examiner

*Primary Examiner* — Jasson H Yoo
(74) *Attorney, Agent, or Firm* — Kerr IP Group, LLC

(57) ABSTRACT

A dual matrix tracking apparatus, system, and method are described herein. The dual matrix tracking apparatus may be implemented at a driving range to facilitate skill-based games, wagering games, and the combination thereof. The dual matrix tracking apparatus includes a first shadow sensor array, a second shadow sensor array, and a control unit. The dual matrix tracking apparatus senses a first projectile position within the first shadow sensor array and associates a first time with the first position. The dual matrix tracking apparatus further senses a second projectile position within the second shadow sensor array and associates a second time with the second position. The control unit then determines a predicted ball flight path from the first ball position, the second ball position, the first time, and the second time.

7 Claims, 22 Drawing Sheets

200

| 202 Item # | 204 Driving Space | 206 Tee Ball-ID | 208 Time HH:MM:SS | 210 Path Data 1 | 212 Path Data 2 | ... | 214 Track-ID |
|---|---|---|---|---|---|---|---|
| 6077 | 12 | 765765876 | 9:45:45 | 1 | 12 | | 21 |
| 6078 | 65 | 876876786 | 9:45:58 | 5 | 16 | | 15 |
| 6079 | 44 | 866593578 | 9:46:43 | 3 | 33 | | 34 |
| 6080 | 09 | 860344777 | 9:46:51 | 65 | 03 | | 12 |
| 6081 | 36 | 888774363 | 9:46:53 | 61 | 56 | | 85 |
| 6082 | 88 | 750369673 | 9:46:58 | 45 | 76 | | 65 |
| 6083 | 17 | 746396375 | 9:47:10 | 12 | 14 | | 34 |

Figure 2

220

| 214 Track-ID | 222 Target 1 % | 224 Target 2 % | 226 Target 3 % | ... | 228 Target X % |
|---|---|---|---|---|---|
| 1 | 2.500 | 1.675 | 0.002 | | x.xxx |
| 2 | 3.952 | 7.654 | 3.95 | | x.xxx |
| 3 | 0.001 | 0.001 | 0.001 | | x.xxx |
| 4 | 3.567 | 3.893 | 3.567 | | x.xxx |
| 5 | 0.004 | 0.002 | 0.004 | | x.xxx |
| ... | | | | | |
| n | aa.aaa | aa.aaa | aa.aaa | | x.xxx |

Figure 3

| | | | |
|---|---|---|---|
| 1 | GOLD | $100 | Prize List A |
| 2 | SILVER | $ 15 | Prize List B |
| 3 | BRONZE | $ 2 | Prize List C |

| ITEM ID | POINTS | NAME | DESCRIPTION |
|---|---|---|---|
| 210 | 500 | New Car | text, photos |
| 300 | 200 | Diamond Ring | text, photos |

| ITEM ID | POINTS | NAME | DESCRIPTION |
|---|---|---|---|
| 12 | 150 | Necklace | text, photos |
| 780 | 50 | Refrigerator | text, photos |

| ITEM ID | POINTS | NAME | DESCRIPTION |
|---|---|---|---|
| 910 | 40 | Blender | text, photos |
| 401 | 60 | Drill | text, photos |

DUAL MATRIX TRACKING SYSTEM AND METHOD

FIELD

The present disclosure relates to a dual matrix tracking system and method. More specifically, the disclosure relates to systems and methods that support tracking objects with a sensor.

BACKGROUND

Golf has been a popular form of entertainment for many years, crossing many cultures. Recently, there has been interest in applying new technology to create new entertaining variants of the game. In particular, driving ranges have become popular, with as many as 100 or more "hitting bays" on multiple levels.

Traditionally, driving ranges were established to allow players to practice their golf game on an open field. During game play, a player strikes a golf ball at a flag placed some distance away and the player visually attempts to determine the landing position of the ball in relation to the flag. In view of the distance travelled by the golf ball, the relatively small size of the golf ball, weather and other such considerations, game play at a driving range has been limited to a singular and personal experience, in which the player could not compete with or play against other players in the driving range.

Recently, driving ranges have increased in sophistication and include targets and score-keeping equipment, which reward the player when the target is hit or when the golf ball lands near the target.

One method for tracking golf balls includes embedding Radio Frequency Identification Devices ("RFID") in golf balls used in the facility. These RFID golf balls have encoded values that can be detected by a generated radio frequency and antenna. The RFID in the ball is associated with a player or a particular hitting bay before it is hit by the player. When the player uses an RFID ball that is hit into a target area, that particular ball RFID is detected at a target equipped with RFID detection devices. This enables electronic scoring of hits on particular targets and the determination of which player hit which target. This information can then be automatically detected by computer systems and used to score games in which the player participates. Other technologies that may be used in combination with, or instead of, RFID identification have also been suggested. These include the use of Doppler-radar, lasers, or one or more high-resolution cameras using computerized image analysis. Some of the aforementioned techniques are presently in use in commercial entertainment centers in the U.S. and overseas.

These developments in golfing and driving range experiences increase the players' entertainment and have been commercialized as a result. Thus, there continues to be interest in improving the players' experience and increase the players' engagement in the driving range experience. One method to increase player engagement and entertainment is to include a wagering option to the driving range experience.

However, a wagering system must have much higher levels of ball tracking accuracy and integrity than are required for an entertainment-only system. In a non-wagering system there is a low standard of precise ball identification required and a relatively high tolerance for error. Thus, the failure to properly identify and register a small percentage of balls at a target or target area may be tolerated up to some reasonable threshold.

In contrast, in a wagering system the cost of a wager and the potential to win monetary awards or other prizes of value reduce the tolerable level of error significantly. The reduced level of tolerable error derives from players' interest in their wager and potential winnings, game operators' interest in regulatory compliance and customer satisfaction, and governmental regulatory requirements. As the stakes of the wager increase, the tolerance for error diminishes. Although there is some reasonable tolerance for very rare errors, i.e. slot machines are typically marked, "Malfunction voids all plays and pays," the error rate must be determined to be a miniscule fraction of a percent. Additionally, in the case of an error, it is typically required that players get refunds for any play cost in the event of a malfunction. Thus, gaming regulators can be expected to require extremely high levels of identification precision, including mechanisms that ensure players are never "cheated," and that the game performs precisely as represented.

However, RFID alone does not provide sufficient reliability for tracking balls in a wagering system. RFID tags embedded in golf balls fail regularly due to the high stress and deformation that occurs when a ball is struck. Additionally, the alternative tracking systems, such as laser-based systems and radar-based systems, suffer from reduced efficacy when mist, fog, rain, or clouds obscure a driving range area.

Thus, a golf wagering system must overcome multiple concerns beginning with improved ball tracking accuracy that accounts for ball identification failure and thereby lowers the level of ball identification errors. Another significant problem that must be solved in such a wagering system is determining how to create games that allow players at many different skill levels to compete for prizes. This problem is significant because a system which allowed the best golfers to have an advantage in winning prizes will not attract the general public in a way required to achieve commercial success, and may violate local regulations.

Thus, a tracking apparatus, system, and method that tracks a projectile or golf ball with a high degree of precision and accuracy during inclement weather conditions. Further, a golf game that includes a wagering element is desirable.

SUMMARY

A dual matrix tracking apparatus and method are described herein. In one embodiment, the dual matrix tracking apparatus includes a first shadow detection array, a second shadow detection array, and a control unit communicatively coupled to the first shadow detection array and the second shadow detection array. The first shadow detection array includes a first plurality of light emitters and a first plurality of shadow sensors disposed about a first plane. The first plurality of light emitters is configured to emit light when a projectile enters the first plane, and the first plurality of shadow sensors is configured to detect at least a first location of each of a first plurality of projectile shadows corresponding to the light emitted by one of the first plurality of light emitters and the projectile. The first plurality of shadow sensors is further configured to transmit to the control unit at least the first location of each of the first plurality of projectile shadows and a first shadow detection array first timestamp associated with the first location of each of the first plurality of projectile shadows.

The second shadow detection array includes a second plurality of light emitters and a second plurality of shadow sensors disposed about a second plane that is separated from the first plane by a nonzero distance. The second plurality of light emitters is configured to emit light when the projectile enters the second plane, and the second plurality of shadow sensors is configured to detect at least a first location of each of a second plurality of projectile shadows corresponding to the light emitted by one of the second plurality of light emitters and the projectile. The second plurality of shadow sensors is further configured to transmit to the control unit at least the first location of each of the second plurality of projectile shadows and a second shadow detection array first timestamp associated with the first location of each of the second plurality of projectile shadows.

The control unit is configured to determine a first projectile position from the first location of each of the first plurality of projectile shadows, a second projectile position from the first location of each of the second plurality of projectile shadows, and a projectile flight path from the first projectile position, the second projectile position, the first shadow detection array first timestamp, and the second shadow detection array first timestamp.

A dual matrix wagering system is also described. The dual matrix wagering system includes a ball, a driving space, a target including a first target area and a second target area, a dual matrix tracking apparatus located at the driving space, a first target prize corresponding to striking the first target area, and a second target prize corresponding to striking the second target area. In the illustrative embodiment, the process of awarding the first target prize triggers a first random game event having an associated first paytable, and the process of awarding the second target prize triggers a second random game event having an associated second paytable, in which the first paytable is different from the second paytable.

FIGURES

The present subject matter will be more fully understood by reference to the following drawings which are presented for illustrative, not limiting, purposes.

FIG. 2 shows an illustrative target ball analysis table.

FIG. 3 shows a table generated for a driving space, including the probability of hitting each possible target based upon different ball trajectories.

DESCRIPTION

Figure 1:
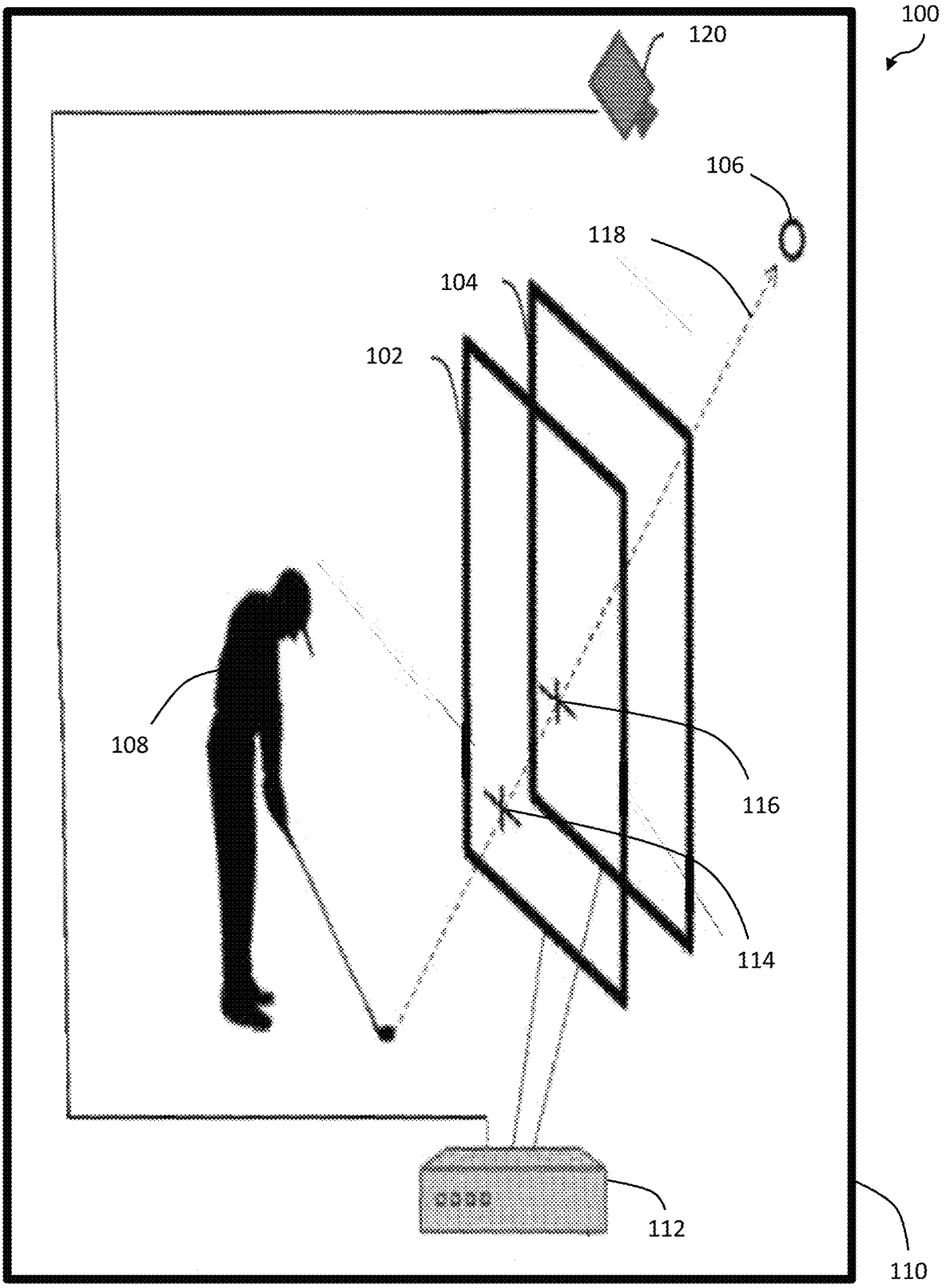
FIG. 1 shows an illustrative dual matrix tracking apparatus.

Persons of ordinary skill in the art will realize that the following description is illustrative and not in any way limiting. Other embodiments of the claimed subject matter will readily suggest themselves to such skilled persons having the benefit of this disclosure. It shall be appreciated by those of ordinary skill in the art that the apparatus, systems and methods described herein may vary as to configuration and as to details. The following detailed description of the illustrative embodiments includes reference to the accompanying drawings, which form a part of this application. The drawings show, by way of illustration, specific embodiments in which the invention may be practiced. It is to be understood that other embodiments may be utilized and structural changes may be made without departing from the scope of the claims.

The dual matrix tracking apparatus, system, and method described herein provide improved projectile tracking to support more complex games of chance, games of skill and the combination thereof. The illustrative embodiments described herein provide an entertaining and secure format for players to exercise their golf skills to earn an opportunity for a bonus wagering game. In one embodiment, the dual matrix tracking apparatus includes a first shadow detection array and a second shadow detection array. In a further embodiment, the dual matrix tracking apparatus is paired with RFID tracking to form a dual matrix tracking system. In a still further embodiment, the dual matrix tracking system includes a radar tracking unit that senses the club, bat, or other hitting element swing path, the initial impact and launch of the golf ball, baseball, or other projectile, and the flight path of that projectile.

The radar tracking units operate by irradiating an area or path with radio/microwave radiation and sensing any radiation reflected off the projectile or hitting element. The sensed radiation is processed and the location of an object, such as the projectile or the hitting element is determined relative to the radar tracking unit from the time between a pulse signal and a return reflection signal. The sensed radiation is also processed to determine the speed of the projectile or hitting element from the Doppler shift in the reflected radiation. In an even further embodiment, the dual matrix tracking system includes a laser tracking unit. Similar to the radar tracking unit, the laser tracking unit irradiates the hitting element, projectile, or any combination thereof and determines a hitting element swing path as well as a projectile flight path.

The various embodiments of the dual matrix tracking apparatus and systems support various game formats. In one game format, the particular target or target area struck by a player determines the type of wagering game the player earns an opportunity to play. In another game format, the particular target or target area struck by a player determines the paytable of the wagering game the player earns an opportunity to play. In a further game format, a golf wagering system provides wagering games randomly or according to a number of balls struck by a particular player.

Illustrative games of skill include, but are not limited to, hitting a baseball in cage, a game of darts, a bowling game, a golf bingo game and other such games of skill. With respect to games of chance, the wagering system disclosed herein may be applied to games of chance such as class II slot machines, class III slot machines, keno games, card games, bingo games, pull-tab games and other such games of chance.

Ball tracking occurs in an illustrative three-step process. The first step is to monitor the impact of the ball at a driving space and the initial trajectory of the ball immediately after it is struck. The second step is to monitor the flight path of the ball. This is important in some systems to measure "hook" and "slice" to accurately gauge where a ball will land. And the third step is monitoring the impact at the end of the shot when the ball lands. In an illustrative embodiment, the impact of the ball is monitored at the target or any portion of the target that is a separate area at which the ball actually lands.

An illustrative embodiment of the dual matrix tracking apparatus 100 is shown in FIG. 1. The illustrative dual matrix ball tracking apparatus 100 increases the reliability of entertainment golf games by providing improved confirmation of the ball being hit and tracking the ball's flight towards a target.

The illustrative dual matrix ball tracking apparatus 100 includes two shadow sensor arrays 102 and 104 that are located in front of where a projectile 106, such as a golf ball may be struck by a player 108. In the illustrative embodiment, a golf ball 106 is the projectile, and the shadow sensor arrays 102 and 104 are located at the front of a hitting bay 110. After a ball 106 is hit by a player 108, the dual matrix tracking apparatus 100 is responsible for identifying the ball flight path 118 and assuring the relationship between the player 108 and the ball 106 is maintained so that when the ball 106 arrives at a target that the player 108 who hit the ball 106 can be identified with certainty.

By way of example and not of limitation, each of the shadow sensor arrays 102 and 104 includes a plurality of LED emitters and sensors. The LED emitters and radiation sensors may be arranged about a frame such as in shadow sensor arrays 102 and 104. The LED emitters may be oriented to project towards one or more of the radiation sensors. The radiation sensors detect the intensity of the light emitted by the LED emitters. When no ball 106 is within the frame of the shadow sensor array 102 or 104 the radiation sensors detect the intensity of radiation emitted by the LED light emitters and transmit the intensity reading to a control unit 112, such as a computer, a processor having memory, or similar computing device. The control unit 112 receives a series of sensed light intensities from each of the various radiation sensors and stores the information in a database in a matrix associating a sensor ID, a sensed light intensity, and a time. When the golf ball 106 enters the frames 102 and 104 the golf ball 106 deflects and scatters the light emitted by the LED emitters, thereby reducing the light intensity sensed at the radiation sensors. By detecting and recognizing these differences in sensed light intensities for each of the various radiation sensors, the ball's 106 position 114 and 116 within the shadow sensor array frames 102 and 104 may be determined by the control unit 112. The control unit 112 stores the determined position information in a second matrix associating a position 114 and 116, a frame 102 and 104, and a time. In this manner, a shadow sensor array or matrix 102 or 104 can detect the presence of an object, i.e. a golf ball, baseball, basketball, dart, or other similar projectile, within the frames.

The shadow sensor arrays 102 and 104 may be similar to devices such as the ShadowSense 81 manufactured by Baanto International Ltd. of Missisuaga, Ontario. By utilizing two such arrays 102 and 104, the control unit 112 determines timestamped X-Y coordinate positions 114 and 116 identifying the ball's passage through each shadow sensor array 102 and 104 frame, it is easy to calculate a velocity vector of the ball 106, which includes speed and direction. The direction of the ball may be used to calculate a Track-ID, which summarizes and approximates a ball flight path 118. One of a finite number of possible projected paths is referred to as a Track-ID.

In an illustrative embodiment, each Track-ID value is a velocity vector comprising a combination of direction of a ball hit and speed of the ball hit. For example, a particular Track-ID may be assigned to balls hit high to the left at a speed of 75 miles per hour ("mph") to 100 mph. Track-IDs may be used to refer to any group of measurable ball attributes including horizontal angle of hit, vertical angle of hit, ball speed, ball spin, and other such ball attributes described below.

In one embodiment, the shadow sensor arrays 102 and 104 operate sufficiently fast, i.e. sub millisecond measurement rates, that multiple scans of the golf ball 106 passing through the frames are obtained. If obtained sufficiently fast, this allows measurement of speed and direction from a single shadow sensor array 102 or 104. When that information is gathered from two shadow sensor arrays 102 and 104, it is possible to examine differences between the speed and direction as measured at each of the two ball positions 114 and 116, which enables the calculation of additional characteristics, including "slice" and "hook," which are deviations in the flight path 118 from a linear plane caused by the spin characteristics imparted by the impact of a golf club on the ball 106. In this manner, the dual matrix apparatus provides a projection of the ball's flight path 118 from a driving space 110 associated with the player 108 to a target.

In another embodiment, the dual matrix tracking apparatus 100 includes RFID readers at the driving space 110 and at the target. The RFID reader located at the driving space 110 confirms the identification of the golf ball 106 before the player 108 hits the ball 106 by reading an RFID or other unique identifier imbedded in the golf ball 106. The precision of the dual matrix tracking apparatus 100 can be improved by confirming the time that the golf ball 106 was hit, and further, determining the direction and speed of the ball 106, as well as where the ball 106 has landed.

From this time and velocity information it is possible to correlate a potential arrival time on a target with an actual target hit, even if the ball that hit the target does not have its RFID read correctly. It is also possible to classify the ball flight path 118 in one of several ways so that the projected path information can be used to analyze multiple golf balls 106 in flight at the time of a target hit and make intelligent decisions on which ball hit what target.

In order to achieve improved error reduction in ball tracking, an intelligent analysis method is utilized. The intelligent analysis method analyzes tables of ball characteristic information to reduce the number of possible identities of received unreadable balls, and to accurately identity the unreadable balls. The intelligent analysis method operates to increase player satisfaction and regulatory compliance by decreasing the incidence of target strikes that are not attributable to a particular player 108.

Referring to FIG. 2, there is shown an illustrative target ball analysis table 200 utilized in the intelligent analysis method. The table describes the various characteristics of each ball 106 hit in the system, including an item number 202 corresponding to a database identifier, an associated driving space 204, a ball RFID 206 recorded when the ball 106 is dispensed to the player 108, a time at which the ball was struck 208, a first flight path data value 210, a second flight path data value 212, a Track-ID 214, and other potential ball characteristic information such as color, bar code, QR code, etc. In one embodiment, the first flight path data value 210 and the second flight path data value 212 correspond to the ball positions 114 and 116. In another embodiment, the first flight path data value 210 and the second flight path data value 212 correspond to a ball position, direction, speed, velocity vector, and any combination thereof. The table 200 may be compiled in a database from the information collected by the control unit 112.

In operation, the RFID of the ball 106 being hit by the player 108 at a driving space 110 is recorded by a driving space RFID reader and the control unit 112 transmits the RFID information to a database that includes the target ball analysis table 200. The shadow sensor arrays 102 and 104 locate the ball 106 within each of the respective frames and the control unit transmits the ball positions 114 and 116 to the database that includes the target ball analysis table 200. The control unit 112 may make a first order determination of the ball flight path 118 from the ball positions 114 and 116 and corresponding timestamps using the equation for motion in the presence of gravity:

$$y = -\frac{g\sec^2\theta}{2v_0^2}x^2 + x\tan\theta,$$

where x and y are position coordinates along a two-dimensional flight path 118, g is the acceleration due to gravity, i.e., 9.80665 meters per second per second ($m/s^2$) and 32.174 feet per second per second ($ft/s^2$), θ is the initial launch angle of the ball 106 with respect to the ground surface. The two-dimensional flight path 118 is determined by the control unit 112 from an angle, φ, between the ball positions 114 and 116, where φ lies in plane parallel to the ground surface.

Thus, the target ball analysis table 200 may include multiple data points corresponding to the ball trajectory 118 received from the control unit 112. The type of information received from the control unit 112 may vary somewhat depending on the tracking units included in the dual matrix tracking apparatus 100 and the corresponding capabilities of those tracking units. In one embodiment, the table 200 includes, at a minimum, the velocity vector of the golf ball as a function of an elevation angle, θ, and the horizontal angle, φ.

In a further embodiment, the dual matrix apparatus 100 senses the ball position within the shadow sensor arrays 102 and 104 every 200 microseconds (μs), allowing for between two and eight ball position measurements by each of the shadow sensor arrays 102 and 104, depending upon the player club speed and resulting initial ball speed. As the number of ball position measurements for a ball strike increase, higher degree modeling of motion in the presence of gravity may be practiced by the processor of the control unit 112, such as by including approximations for air resistance, factoring effects from ball spin, such as the degree of hook, slice, excess elevation, reduction in elevation, and any combination thereof. Air resistance approximations may further encompass weather measurements such as humidity, pressure, and wind velocity, incorporated from internet weather sources or local weather devices.

In a further embodiment, the dual matrix tracking apparatus 100 may further include a high-definition camera 120 positioned to monitor the ball flight out of the hitting bay or driving space 110. The high-definition camera 120 is communicatively coupled to the control unit 112. Analysis of the camera video provides another tool for refining the estimation of the flight path 118 based on observed "hook" and "slice." The observed "hook" and "slice" may be used to determine accurate approximations for the effects of ball spin.

In the illustrative embodiment shown in FIG. 2, a summary of all the information contained by the table 200 may be consolidated into a track ID 214 for each ball 106. The track ID 214 represents a mapping of the projected ball path to one of N predetermined groups. The N predetermined groups may be embodied or organized in several different fashions described herein.

In an illustrative embodiment, each Track-ID value 214 is a combination of direction, i.e. φ and θ values, of a ball hit and speed. For example, a particular Track ID 214 may be assigned to balls hit high to the left at a speed of 75 miles per hour (mph) to 100 mph. Track-IDs 214 may be used to refer to any group of measurable ball attributes including horizontal angle, φ, of hit, vertical angle, θ, of hit, ball speed, ball spin, and other such ball attributes.

Referring now to FIG. 3, there is shown a matrix 220 generated for a hitting bay or driving space 110 showing the probability of hitting each possible target 222, 224, 226, and 228 based upon various ball trajectories. This table 220 has n rows, each row corresponding to a track ID 214 for that bay 110. The table 220 has a column for each target on the range or hitting area at which the dual matrix tracking apparatus 100 is implemented. For each combination of target and track ID 214 a percentage weight is assigned, which is the probability that a ball hit on the track ID 214 hits a particular target. As an example, if the track ID 214 suggests hitting a ball 100 yards toward the leftmost portion of the range, the probability of that ball hitting any target in the rightmost section of an illustrative range will be near zero. As the track ID 214 suggests an impact closer to the target the probabilities reported in the table for certain targets will increase.

Figure 4:
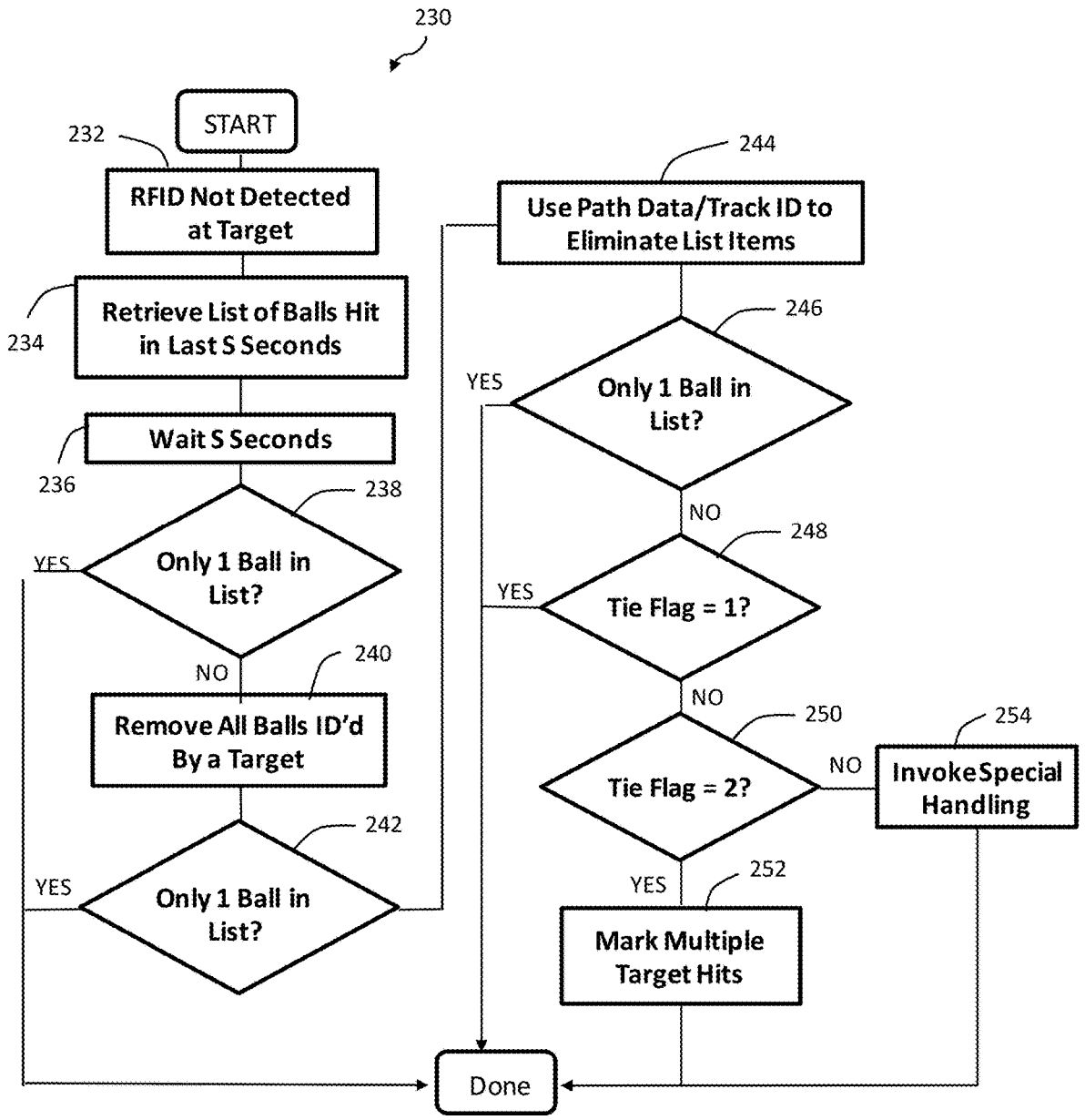
FIG. 4 shows an illustrative intelligent analysis method that dramatically reduces the error rate experienced by players and enables many unidentifiable golf balls to be properly associated with the bay from which they were hit.

Referring to FIG. 4 there is shown an illustrative method 230 that enables many unidentifiable balls to be properly associated with the bay or driving space 110 from which the balls were hit, thus dramatically reducing the error rate experienced by a player 108 or the facility at which the dual matrix tracking apparatus is implemented. The illustrative method 230 achieves a reduced error rate by minimizing the occurrence of an unidentifiable ball. The probability of having an unidentifiable ball may never be zero because the traumatic hit of a golf club to a golf ball 106 with imbedded electronics, such as an RFID tag, is likely to inevitably cause a failure. Additionally, crosstalk interference may prevent an RFID reader from detecting an RFID signal radiated by a ball 106. Crosstalk may occur where several RFID tags emit repeated or frequent RFID signals due to the proximity of the balls to one another and to one or more RFID readers located at a plurality of targets.

The method 230 begins at step 232 when the RFID detector in the target detects a ball 106 with an unreadable RFID. The RFID detector communicates, by wire, cable, radio signal, WiFi, or any combination thereof, with one or more control units 112. The method 230 retrieves a list of all balls hit during a period of time, e.g. "S" seconds, at step 234. In one embodiment, the period of time may be from the time the unreadable RFID was detected to S seconds before the unreadable RFID was detected. At block 236, the method 230 waits W seconds, as indicated by parameter W in the database. The method retrieves from the database the list of all balls hit in the last "S" seconds, wherein "S" is predetermined as the reasonable minimum number of seconds that a ball could be in flight and settle into the target to be detected.

At decision diamond 238, the method 230 determines that if there is only ONE ball in the list, then the point of origin is that ball's hitting bay or driving space, and the method 230 is complete because the point of origin has been determined through measurement, Global Positioning System (GPS), or any combination thereof. At step 240, the list is examined for any balls 106 that have already been identified as arriving at another target. Those balls are eliminated from the list. At decision diamond 242, the method 230 determines whether there is only ONE ball left in the list, and if so the method 230 is complete.

At step 244, the track ID data 214 is used to eliminate ball hits for all balls for which the probability of hitting the target in question is below a specified threshold, i.e., only for zero probabilities, for all probabilities below 0.01%, for all probabilities below 1%. At decision diamond 246, the method 230 again determines that if the number of possibilities left is ONE, then the process is complete. In the event that there remains more than ONE possibility, a Tie Flag is associated with the unreadable ball target hit in the database. The Tie Flag is a system configuration variable, settable according to preconfigured operating settings. At decision diamond 248, if the Tie Flag is set to ONE, then a target strike is awarded to the most probable driving space 110 from which the ball 106 that struck the target was hit. At decision diamond 250, if the Tie Flag is set to TWO then it is considered a tie and ALL items left in the list are marked as hitting the target 252. At decision diamond 250, if the Tie Flag is set to THREE then special handling 254 is invoked. In some embodiments, special handling 254 includes making a judgement according to a special rule set or providing human judgment.

Figure 5:
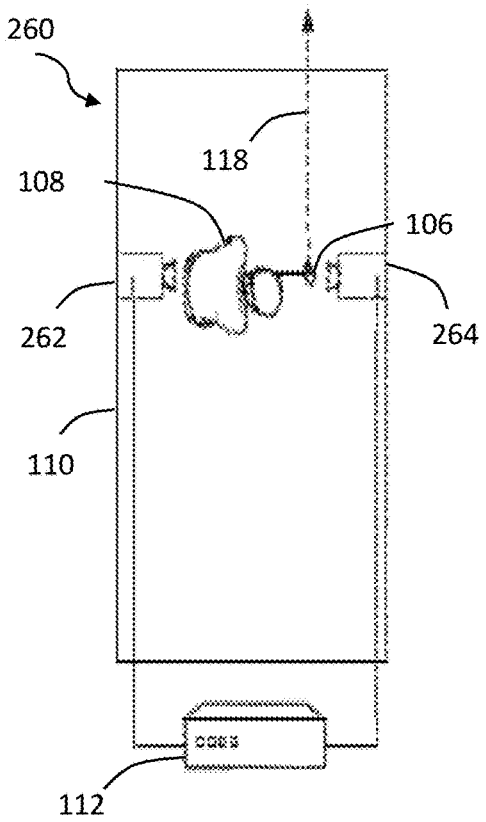
FIG. 5 shows an illustrative dual matrix tracking apparatus incorporating cameras behind and facing the player.
Figure 6:
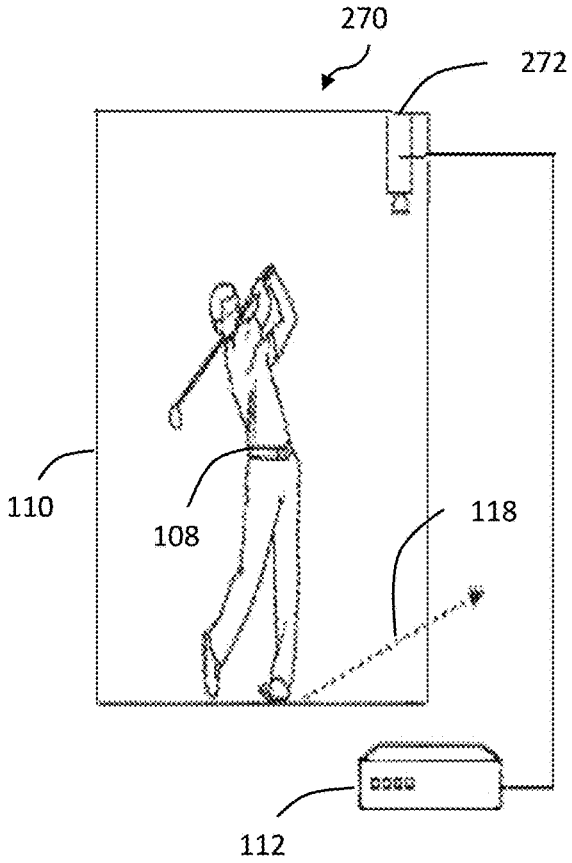
FIG. 6 shows an illustrative dual matrix tracking apparatus incorporating a camera above the player.
Figure 7:
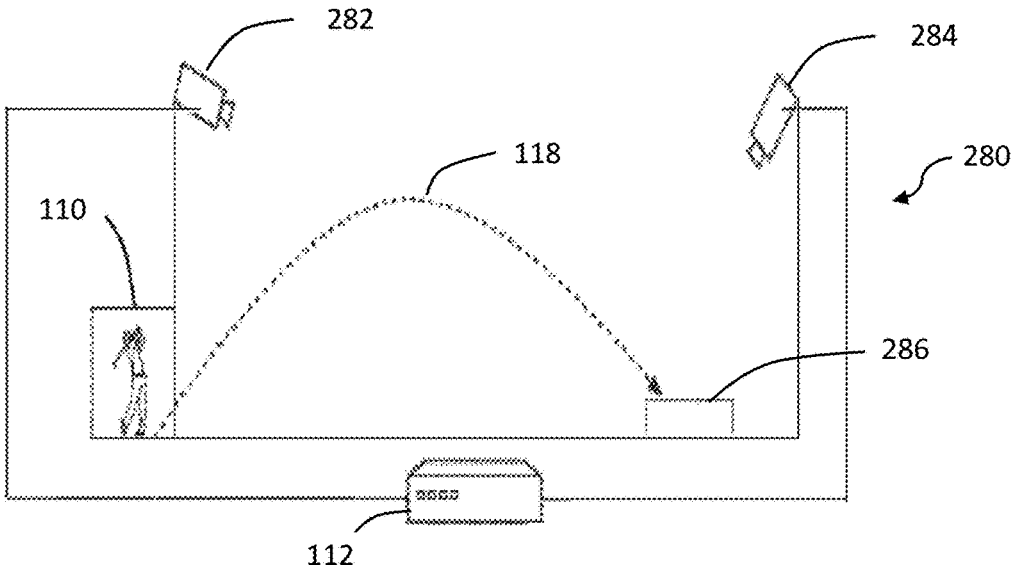
FIG. 7 shows an illustrative dual matrix tracking apparatus incorporating cameras mounted on the hitting bay and at the target.

With reference now to FIGS. 5, 6, and 7, there are shown multiple further embodiments 260, 270, and 280 wherein one or more video cameras 262, 264, 272, 282, and 284 provide sufficient resolution, picture quality, and state-of-the-art in software analysis of video images to provide a redundant system for tracking a ball from driving space-to-target. Such redundancy supports high integrity ball tracking sufficient for regulatory wagering requirements. The control unit 112 integrates multiple video images, or, alternatively, combines those images with other detectable measurements or events recorded by elements of the dual matrix tracking apparatus 100. In an illustrative embodiment including the cameras 262, 264, 272, 282, and 284, the cameras capture the 3 stages of a golf ball's path from hitting bay or driving space 110 to a target 286. Multiple cameras 262, 264, 272, 282, and 284 can be placed in and around the hitting bays or driving spaces 110 to provide a clear video image of the balls 106 that are struck, even if some camera angles are blocked. Referring now to FIG. 5, a camera 264 viewing the ball from in front of a right-handed golfer 108 would be blocked if the golfer 108 were a left-handed golfer and put his body between the golf ball and camera 264. However, camera 262 would view the ball 106 from in front of the left-handed golfer.

In one embodiment, the control unit 112 analyzes the various camera images and records, minimally, the time that the ball is struck, the speed of the ball leaving the hitting bay or driving space 110, and the angle of horizontal inclination, θ. With reference now to FIG. 6, there is shown a further embodiment wherein a camera 272 is placed overhead of the golfer 108 and golf ball 106. Such an overhead camera 272 is capable of recording the left-to-right angle, φ, of a hit or drive flight path 118. The overhead camera 272 may also be able to make a determination of any left or right turning of the trajectory, i.e., "hook" or "slice," that results from ball spin.

Referring now to FIG. 7, after the ball 106 has the left hitting bay or driving space 110, one or more overhead cameras 282 positioned above the hitting bays 110, will have a separate and distinct opportunity to capture the flight path 118 of the ball 106 and, with a wider view than any cameras 262, 264, and 272 in the hitting bays 110. This wider view allows cameras 282 and 284 specifically to capture any left or right turning in the trajectory, i.e., "hook" or "slice." The control unit 112 is communicatively coupled to the cameras 262, 264, 272, 282, and 284, and determines a ball hit time and ball flight path 118. From this ball characteristic information, a likely destination target or targets 286 can be determined.

Using time and angle measurements, i.e. φ and θ values, from all cameras 262, 264, 272, 282, and 284 employed in any particular embodiment, the control unit 112 can integrate the observed flight paths into the higher order approximations of the motion equation for the golf ball 106 and produce an accurate record of each ball hit, its flight trajectory 118, and what target 286 was hit or whether any target 286 was hit.

Figure 8:
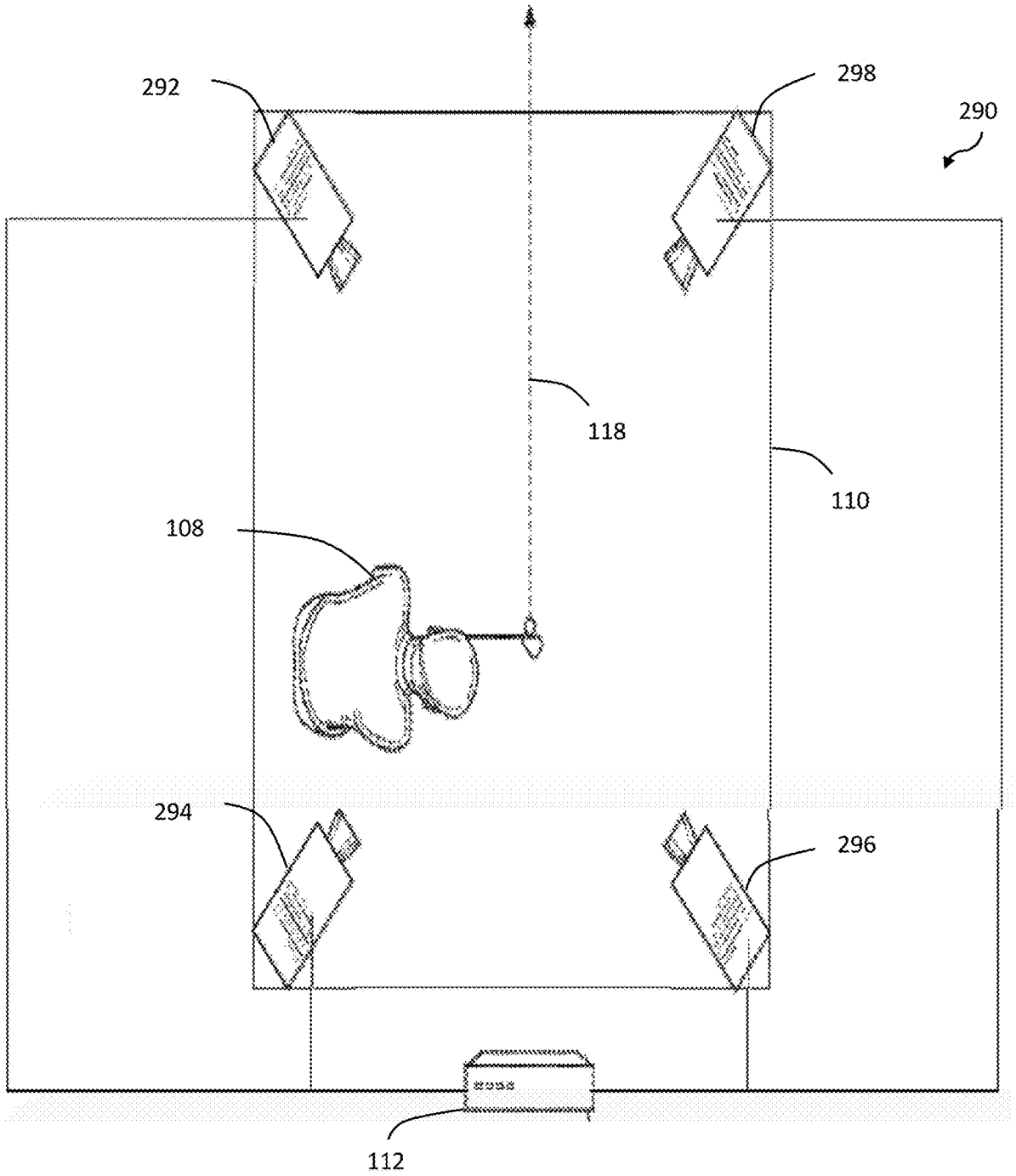
FIG. 8 shows an illustrative dual matrix tracking apparatus incorporating a plurality of infrared cameras mounted so that the cameras can view the driving space at all times.

Referring now to FIG. 8, there is shown another illustrative embodiment 290 that includes a plurality of infrared cameras 292, 294, 296, and 298 mounted so that the cameras 292, 294, 296, and 298 can view the portion of the driving space where the player 108 hits the ball 106 at all times and communicates the images to the control unit 112. By identifying the ball images and tracking their angular motion, the exact position of all balls 106 is readily calculated by the dual matrix tracking apparatus 100. In such embodiments, there is enough camera coverage to prevent normal obstruction of some camera angles by the player 108 from hindering proper identification.

Figure 9:
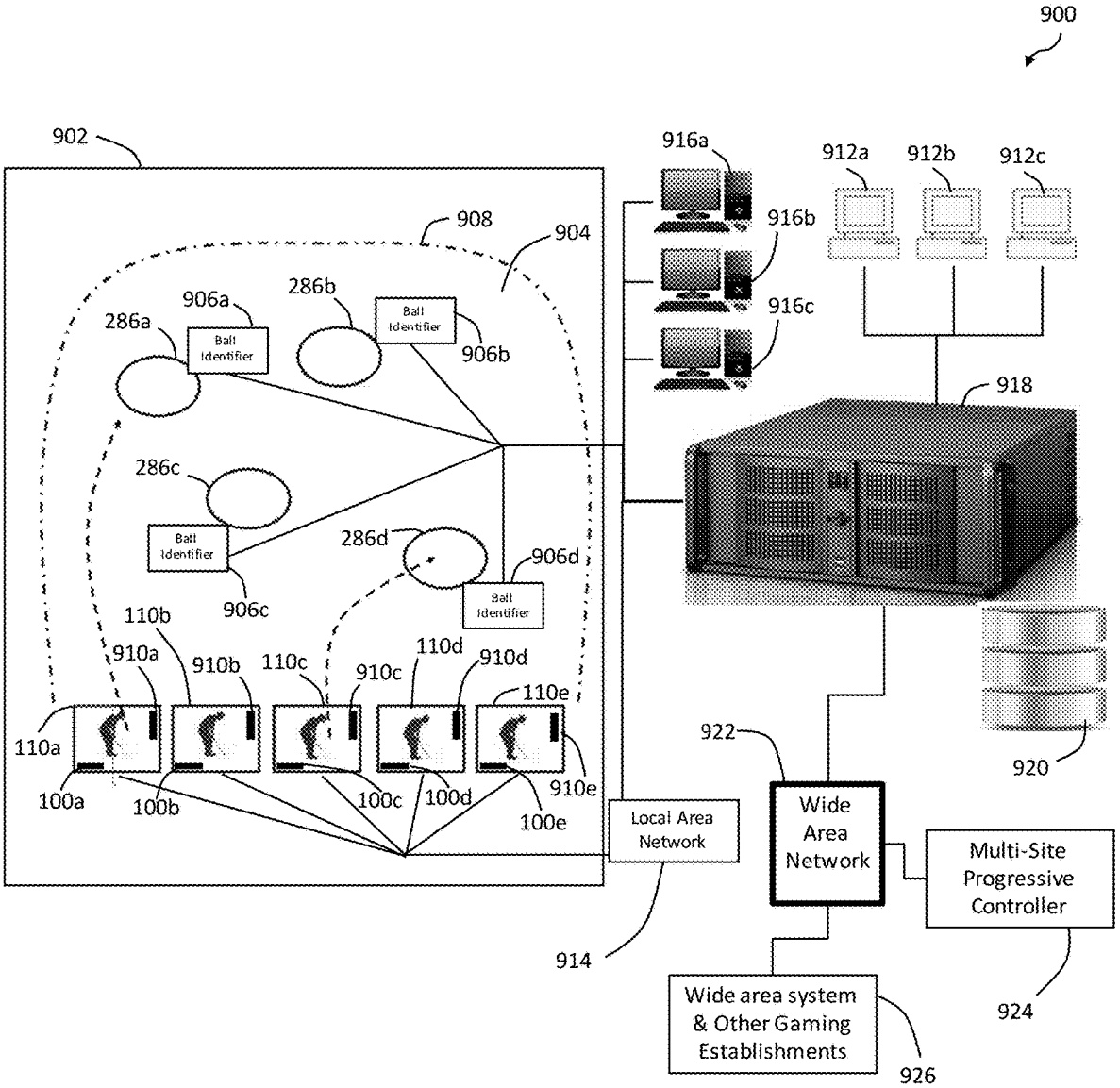
FIG. 9 shows an illustrative dual matrix wagering system comprising a driving range with targets and the computing infrastructure supporting the dual matrix wagering system.

Referring now to FIG. 9, there is shown another embodiment wherein the dual matrix apparatus 100 may be incorporated in an illustrative dual matrix wagering system 900 to track balls 106 at, for example, a driving range 902. In the illustrative embodiment, the dual matrix apparatus 100 analyzes the location of balls 106 before the ball is hit, and may track a multiplicity of balls 106, each potentially with a known RFID tag. In so doing, the dual matrix apparatus 100 provides positive confirmation of which ball 106 was struck from a particular driving space 110 and the time at which the hit occurred. The dual matrix wagering system 900 provides a player 108 with the opportunity to play a game session wherein the player 108 hits a ball 106 and receives a prize for striking a target 286. The particular target 286 or target area struck has an associated paytable for a random game event triggered by the target strike. The paytable may differ depending on the particular target 286 or target area struck.

The dual matrix wagering system 900 includes a plurality of golf balls 106, each having at least one unique identification indicator, such as an RFID tag, a target range 904 including one or more targets 286 each with an associated ball identifier module 906, which may include an RFID reader, a netting enclosure 908 surrounding the target range 904, one or more driving spaces 110 each with an associated player interface unit ("PIU") 910, and one or more point-of-sale ("POS") stations 912. The dual matrix wagering system 900 is supported by a local area network ("LAN") 914 communicatively coupling the targets 286, the driving spaces 110, the POS stations 912, one or more management terminals 916, and a server 918. The server 918 includes a database 920 for tracking ball hits and target activity. The server 918 is communicatively coupled through a wide area network ("WAN") 922 to a multi-site progressive controller 924.

By way of example, the illustrative targets 286 are disposed within an enclosed target range 904 that includes an illustrative netting 908, a wall or other suitable barrier that prevents an errant golf ball 106 from causing damage outside the property. Additionally, the illustrative netting 908 prevents golf balls from entering target range 904 from outside the boundary established by the illustrative netting 908 or wall.

The golf balls 106 include at least one unique identification indicator, which may be embodied as an RFID chip and antenna embedded in the golf ball 106. The unique identification indicator may also be embodied as a color, a printed bar code, a printed QR code, or other such identifier that corresponds to the unique identification indicator. Additionally, the golf ball 106 may include one or more unique identifiers that may be electronically generated and operate in a manner similar to the RFID golf ball 106.

At least one of the illustrative targets 286 include a ball identifier module 906, represented by ball identifier modules 906*a*, 906*b*, 906*c*, and 906*d*, that identifies the unique identification indicator corresponding to a golf ball. By way of example and not of limitation, the golf ball may include an RFID component that wirelessly transmits the unique identifier and the ball identifier module 906 is an RFID reader configured to read the unique identification indicator transmitted by the RFID golf ball 106. In various embodiments, the ball identifier module 906 is an RFID reader, a QR reader, a bar code reader, an optical scanner, or any combination thereof. The ball identifier modules 906 are communicatively coupled to the network 914 and thereby transmit target strike information including the target strike time and ball identification to the server 918, which stores the target strike information in the database 920. This allows the server 918 or the control unit 112 to accurately identify golf balls 106 received at the targets 286, and associates balls received at the targets 286 with the hitting bay 110 from which the balls were struck and the player 108 who struck each ball 106.

The illustrative dual matrix wagering system 900 supports communications between the server 918, the database 920, the PIU 910, and the dual matrix tracking apparatus 100 that enable the coordination of events and recording of information relating to the player 108, player selections input at the PIU 910, identification of golf balls 106, game play states, game play results, and player accounting. The server 918 also communicates with other system components as described in further detail below.

The LAN 914 supports communication between the various components of the dual matrix wagering system 900, such as the POS stations 912, the PIUs 910, the hitting bays 110, the ball identifier modules 906, and the management terminals 916. The illustrative POS stations 912 may be manned cashier stations, unmanned electronic kiosks for setting up player account, or other systems and methods for collection of play funds that can be used by the player and redemption of prizes by the player. Some of these processes may also be accomplished through the PIUs 910 in each illustrative hitting bay 110. The PIU 910 is described in further detail below in FIG. 10. The management terminals 916 are connected via the LAN 914 to the server 918 in order to manage game configurations, control system operation, and provide financial and other data related to golf system operations.

The management terminals 916 are communicatively coupled to the PIUs 910. Each PIU 910 allows the player to select game types, the denomination of wagers the player wishes to engage in and other characteristics of game play. The ball identifier modules 906 within the targets 286 allow a struck ball to be identified using RFID or another unique ID indicator, and stores the ball identification in the database 920. The server 918 associates the uniquely identified ball with the player who struck the ball of a particular hitting bay 110 from which the uniquely identified ball was hit.

The management terminals 916 may be used by authorized personnel to manage facility operation, configure the systems, monitor operations and access other functions required to support features of the dual matrix wagering system 900. Any player may also access their account to redeem values that were previously won or deposited. The targets 286 may include one or more sensors (not shown) that are used in a mechanical randomization process to detect the actions of a mechanical randomizer and/or ball and report the result to the server 918, the PIU 910, or any combination thereof.

In one embodiment, the dual matrix apparatus 100 is communicatively coupled to the server 918 via the LAN 418, and thereby linked to a video and/or audio alert system, that can confirm to the player 108 that the dispensed ball is properly identified and ready for play. The video and/or audio alert system may be embodied as an element of the PIU 910. For example, the video and/or audio alert system may be embodied by displaying a green light at the PIU 910 when the dispensed ball is identified and a red light when no ball is properly identified for dispensing.

In various embodiments, the dual matrix wagering system 900 is communicatively coupled to a multi-site progressive controller 924 via a WAN 922, e.g. the Internet. Progressive prizes are prizes that grow in real time as a function of game play. Progressive prizes often accumulate prizes from multiple locations. The multi-site progressive controller 924 supports multi-venue progressive games or access to other gaming establishments 926 that include common prizes. For example, a common prize may include a pari-mutuel game of skill that is commonly played by players from different gaming facilities.

By way of example and not of limitation, the illustrative pari-mutuel game of skill described above may be embodied as a Bingo game, in which numbers are drawn from a single pool and the player or players match the drawn numbers with numbers contained on their bingo card or cards. The illustrative matrix or "bingo card" used in the traditional game of bingo contains five rows and five columns, with each card used in the game containing numbers, some of which differ from card to card. The five columns of the card are labeled 'B', 'I', 'N', 'G', and 'O' from left to right. The center space is usually marked "Free" or "Free Space," and is considered automatically filled. The range of printed numbers that can appear on the card is normally restricted by column, with the 'B' column only containing numbers between 1 and 15 inclusive, the 'I' column containing only 16 through 30, 'N' containing 31 through 45, 'G' containing 46 through 60, and '0' containing 61 through 75. Each card used in a bingo session varies from player to player and contains a different combination of numbers 1 through 75.

While the object of a traditional bingo game is merely to become the first player to cover all of a row or column on that player's card, variations of the game have evolved which may include being the first to achieve covering certain predetermined patterns, or playing until a player achieves a top-level prize by reaching a predetermined goal. Additionally, various platforms have been developed such as those used in the gaming industry, where electronic bingo machines operate similar to traditional casino games. However, each of these games is ultimately based upon a random game event. An illustrative example of a predetermined winning card is a "Four Corners Bingo" game. In four corners bingo, the winner is the first player to have the top and the bottom corners under the letters "B" and "O" filled. In some variants a special "progressive" prize is attached that is won if the 4 corners are completed in a small number of ball draws, e.g. four. The "progressive" prize grows over multiple games as a portion of all game play cost is applied to the growing "progressive" prize. Due to the difficulty of achieving the 4 corner prize in 4 draws, such a prize can get large, which in turn increases player participation and excitement. In "Death Bingo", a player is eliminated when he gets a bingo, and the last player standing is the winner and receives a prize. In a variation of this game, a twist is added in that the other players may have at least one space filled when a departing player gets a bingo. There are many variants of bingo and bingo prizes possible.

It should be clear to those with ordinary skill in the art that although the game is described as "BINGO" in a traditional sense, that the presently disclosed subject matter applies to any game whereby the player has one or more matrices of numbers, letters or symbols or similar designations, arranged into a pattern, typically, but not exclusively, configured in rows and columns, wherein there is a centralized draw sequence for all players in the game from a pool of corresponding numbers, letters or symbols, and winners are determined by which a player can complete one or more predetermined patterns on one or more of their matrix patterns first, or within a certain number of draws. Similarly, the game may be played in a number of grid, matrix or board variations, such as 4×4, 3×6, or even an objective oriented game structure such as the game of "Risk" or "Trouble".

In an illustrative example of the bingo golf embodiment, the dual matrix tracking system further includes a plurality of bingo targets that are disposed in the driving range, and each of the plurality of bingo targets includes a ball identifier. The plurality of bingo targets includes a "B" target, an "I" target, an "N" target, a "G" target and an "0" target, or a similar matrix structure of number, letters or symbols. The game session includes a plurality of game events, and at least one game event is triggered by the ball striking or coming to rest at one of the plurality of targets.

The multi-site progressive controller 924 works in a manner similar to WAN progressive systems currently in widespread use for gaming machines in Nevada and other jurisdictions throughout the United States and around the world. In one embodiment, a worldwide golf progressive jackpot is enabled, in which progressive controller 924 on a multi-jurisdictional system is enabled to handle play and prizes at multiple sites and/or in multiple currencies.

In some embodiments, a progressive prize can be set up so that very large prizes can be established as a function of play by multiple players either in the same or multiple facilities. A progressive prize is one that grows in real-time. The progressive prize may grow as a function of game play, game winnings, time or one or more other formulas. In that way, a very large prize value can be offered, which will grow in time and cause increasing levels of player excitement and increased play.

By way of example and not of limitation, the dual matrix wagering system 900 is configured to interface and communicate with enterprise systems over the LAN 914 or the WAN 922 that provide additional services such as ordering systems for food and beverage establishments, enterprise resource planning systems, and other such technologies. In one embodiment, the player 108 may select these additional services through the PIU 910 in the player's hitting bay 110.

Figure 10:
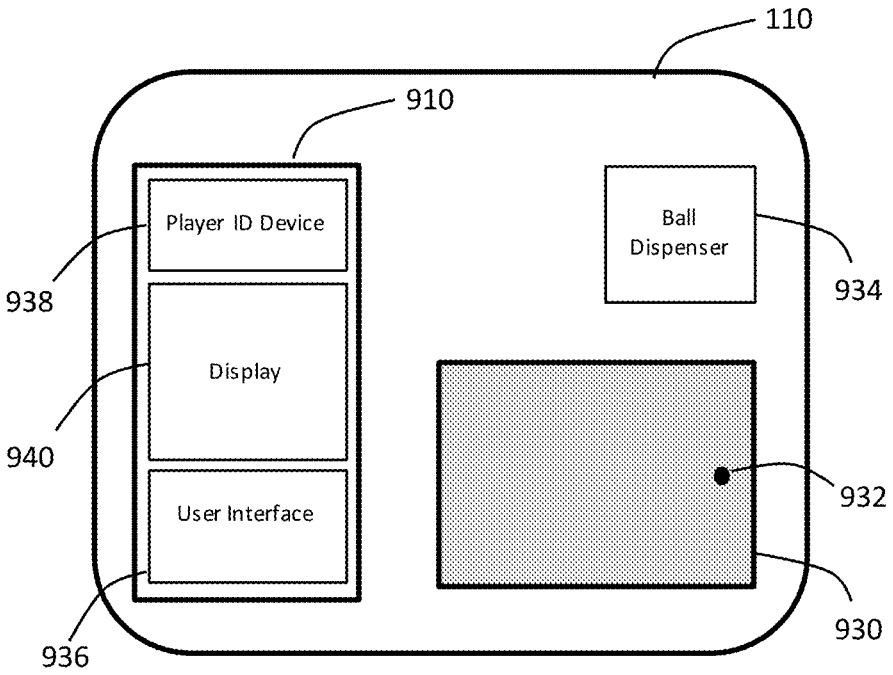
FIG. 10 shows a driving space and the associated elements of the driving space.

With reference to FIG. 10, the illustrative hitting bay 110 includes a mat or driving surface 930 having a tee area 932 from which the golf ball 106 is struck by the player 108, a ball dispenser 934, and a PIU 910 having a user interface 936 capable of receiving user input, which can be one or more of touch-screens, keypads, motion-sensing devices or personal computing devices.

The PIU 910 also includes a player identification device 938 which identifies the player to the dual matrix wagering system 900. The player identification device 938 may identify the player with the use of at least one of a bar code reader, a magnetic stripe reader, a NFC reader, a QR code, or other such mechanism associated with personal computing devices, e.g. a mobile device. The PIU 910 may also include a display 940 that displays an illustrative game outcome or other such display information.

Figure 11:
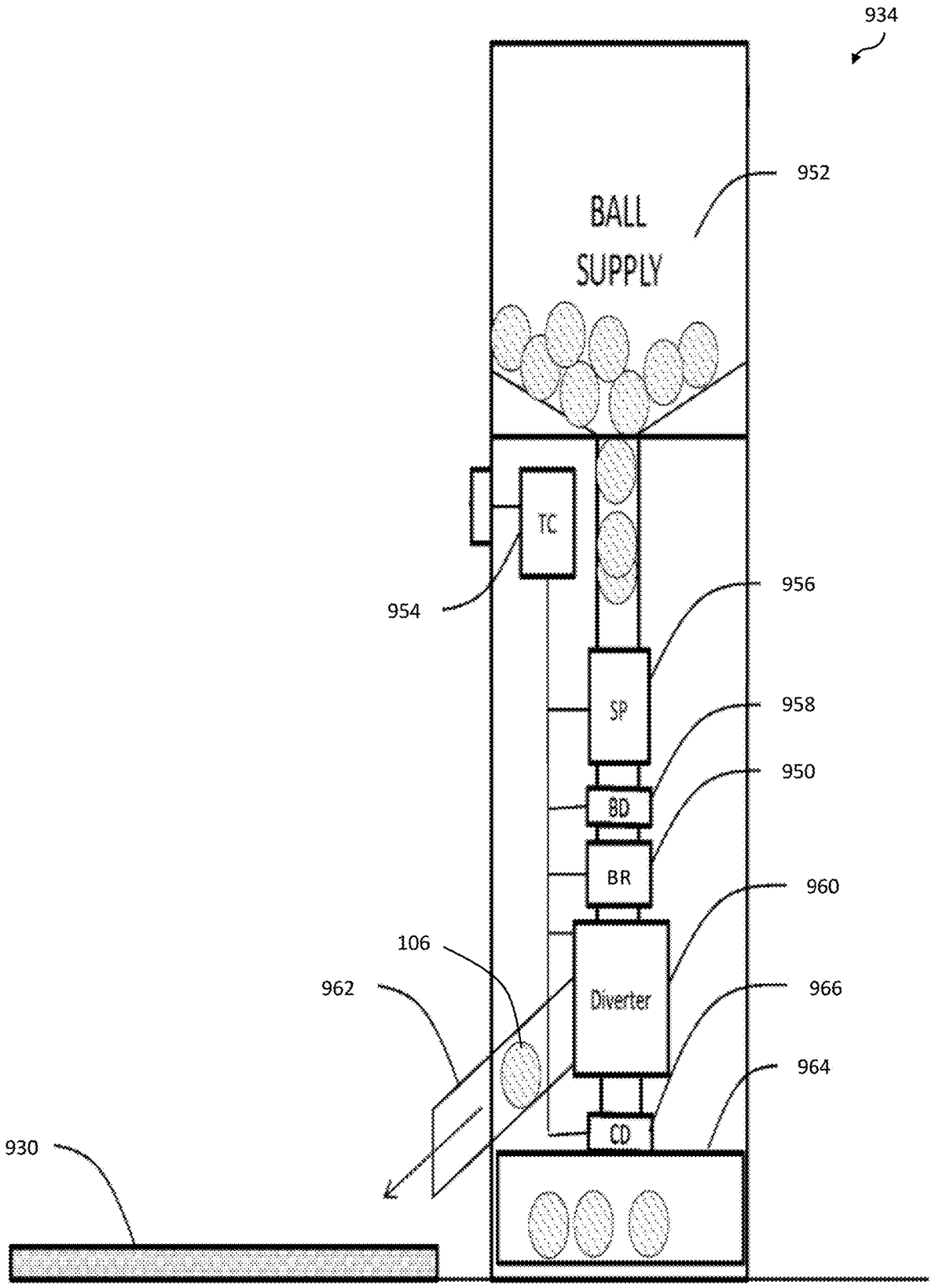
FIG. 11 shows a detailed view of an illustrative ball dispenser.

With reference now to FIG. 11, the ball dispenser 934 dispenses golf balls 106 to the mat 930. The ball dispenser 934 verifies the unique ball identifier for each ball 106 to be dispensed, to confirm that dispensed balls 106 have a readable identification indicator and communicate the applicable identifier to a control unit 110, which may be embodied as a server, a virtual server, a client, a peer computing device, a controller, a control system, a field programmable gate array, and other such computing devices. In various embodiments, a ball reader 950 verifies the unique ball identifier for each ball to be dispensed, and confirms that dispensed balls have a readable identification indicator. The ball reader 950 may be an RFID scanner, a QR reader, a bar code reader, or other such optical scanning device.

In various embodiments, the ball dispenser 934 receives golf balls from a ball supply 952. The golf balls 106 may be either hand-loaded, loaded through a conveyor, loaded with a vacuum system or other such loading system. The ball dispenser 934 is activated by a player 108 initiating a game session at the PIU 910. In one embodiment, the dispensing of the ball 106 may be authorized when the player identification is verified and it is determined that the player 108 has funds sufficient for game play.

The ball dispenser 934 may be communicatively coupled to a tee controller 954, e.g. a microprocessor, that activates a single-pass device 956 that allows a single ball 106 to leave the ball supply 952 and pass a ball detector 958. The tee controller 954 may be communicatively coupled to the control unit 110 and thereby to the server 918, or directly to the server 918. The illustrative ball detector 958 includes an optical sensor that confirms to the tee controller 954 that a ball has been dispensed by the single-pass device 956. In various embodiments, other sensors capable of confirming the presence of a golf ball 106 may be employed.

The ball reader 950 then proceeds to read the ball 106 that has passed the ball detector 958. The ball reader 950 reads the unique identifier corresponding to a particular golf ball 106 as the ball 106 passes through the ball reader 950 and communicates the read identifier to the tee controller 954, and thereby to the server 918, which updates the database 920.

If the tee controller 954 receives the ball identifier from the ball reader 950, then the tee controller 954 activates a diverter 960. The diverter 960 transfers the golf ball 106 down a dispensing chute 962 onto the mat 930, where the ball can be hit by a player.

If the ball reader 950 fails to identify the golf ball 106, then the diverter 960 routes the unidentified golf ball 106 to a failed ball holder 964. Balls 106 in the failed ball holder 964 are periodically collected and removed from the dual matrix wagering system 900. In various embodiments, the dual matrix wagering system 900 further includes a capacity detector 966. The capacity detector 966 may include one or more optical sensors (not shown) that detect an "overfull" ball holder 964. The capacity detector 966 is communicatively coupled to the tee controller 954, and the tee controller 954 will deactivate the ball dispenser 934 until the overfull ball holder 964 is corrected.

Communication between elements within the hitting bays 110 is facilitated by the secure LAN 914. In various embodiments, the computer server application may be located within the hitting bay 110. In other embodiments, the computer server application may be in a separate location.

Figure 12:
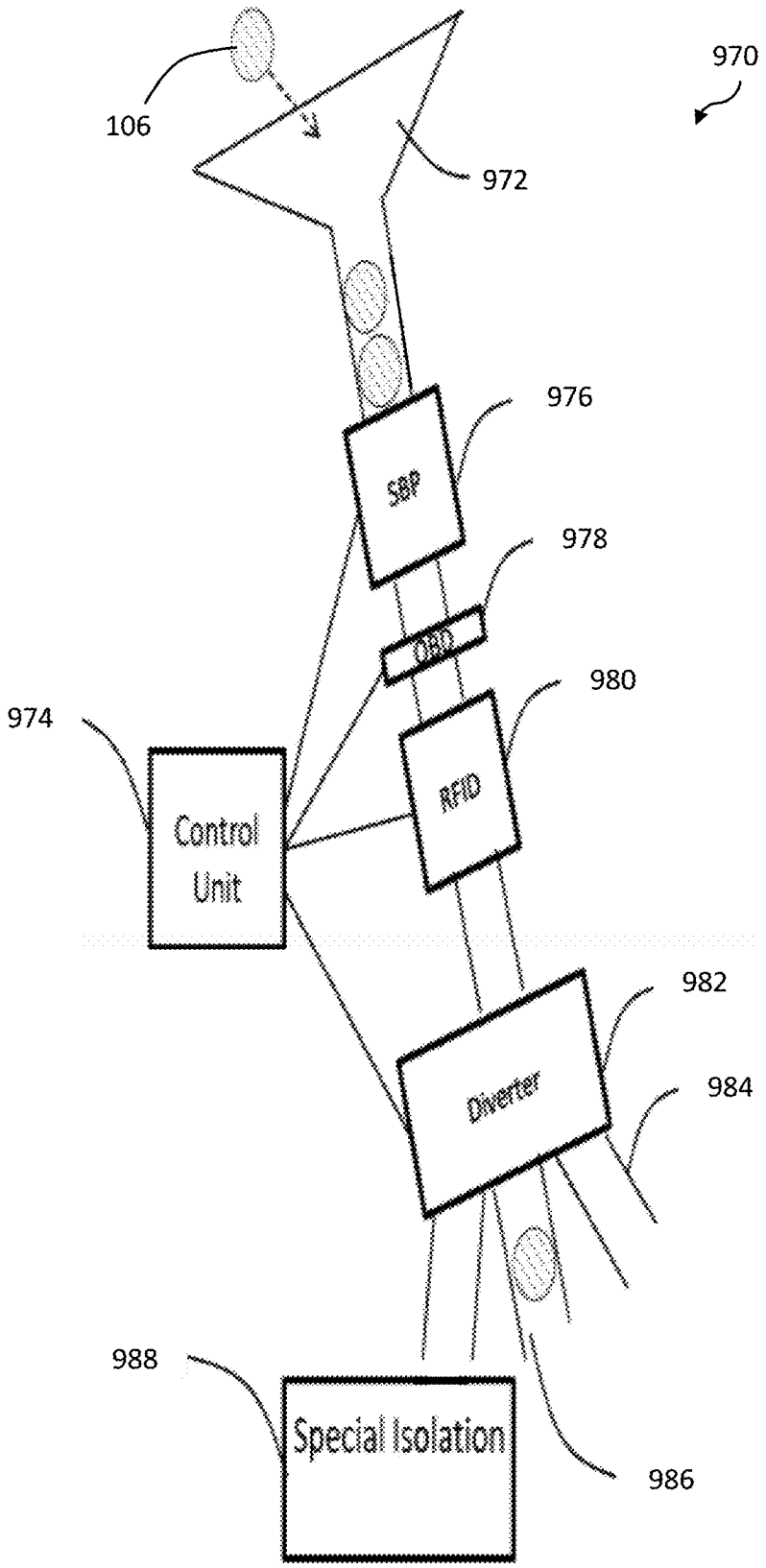
FIG. 12 shows an illustrative target ball acceptor that processes balls that strike the target.

Referring now to FIG. 12, there is shown an illustrative embodiment of a target ball acceptor 970 located at a target 286, wherein the target ball acceptor 970 receives and processes the balls that strike a target 286. In the illustrative embodiment, the target ball acceptor 970 is located below the target 286, which target 286 includes at least one opening into which received balls 106 travel via a funnel or entry area 972 into the target ball acceptor 970. The target ball acceptor 970 processes balls 106 that strike the target 286. In some embodiments, the targets 286 may further include a plurality of target areas, wherein each target area is operatively coupled to a separate target ball acceptor 970. Balls enter through the entry area 972 and, under the control of a target control unit 974, pass through a single-ball-pass unit 976, which allows only one ball 106 at a time to be processed. A ball detector 978 confirms to the control unit 974 that a ball has passed. The ball detector 978 may be an optical ball detector, such as a camera, laser, etc. A target ball identification indicator reader 980 will report the RFID or other unique identifier of the ball to the control unit 974 and via the network 914 to the server 918. If there is no RFID or other unique identifier read by the target ball identification indicator reader 980 when the ball detector 978 detects a ball, then the control computer 974 sends a message to a diverter 982 to send the unidentifiable ball to a rejected ball chute 984. Upon receiving such a message, the diverter 982 selects rejected balls or balls without readable RFID signals or other unique identification indicators for rejection and disposal or repair by routing them through the reject ball chute 984. In some embodiments, the rejected and unidentifiable ball strike at the target 286 is reported to the control unit 974 and thereby the server 918 for possible determination of the source driving bay 110 and player 106, through intelligent analysis, as described herein. Balls with readable signals will be reported to the server 918 by the target control unit 974 and upon receiving a message that the ball has been read by the target ball identification indicator reader 980, the diverter 982 selects the ball 106 for routing down a normal return chute 986 where the balls will be available for collection and return to normal play.

When a ball is of sufficient interest, as it would be if there was a high-value prize associated with the target 286 struck, target area struck, or the game session outcome, the target control unit 974 is configured to route certain balls to a special isolation area 988. In some embodiments, the special isolation area 988 may be a locked container where balls that are associated with high-value prize strikes are retained for security and validation purposes. In operation, the server 918 or target control unit 974 sends a message to the diverter 982, causing the diverter 982 to select a particular ball and route that ball to the special isolation chamber 988.

Figure 13:
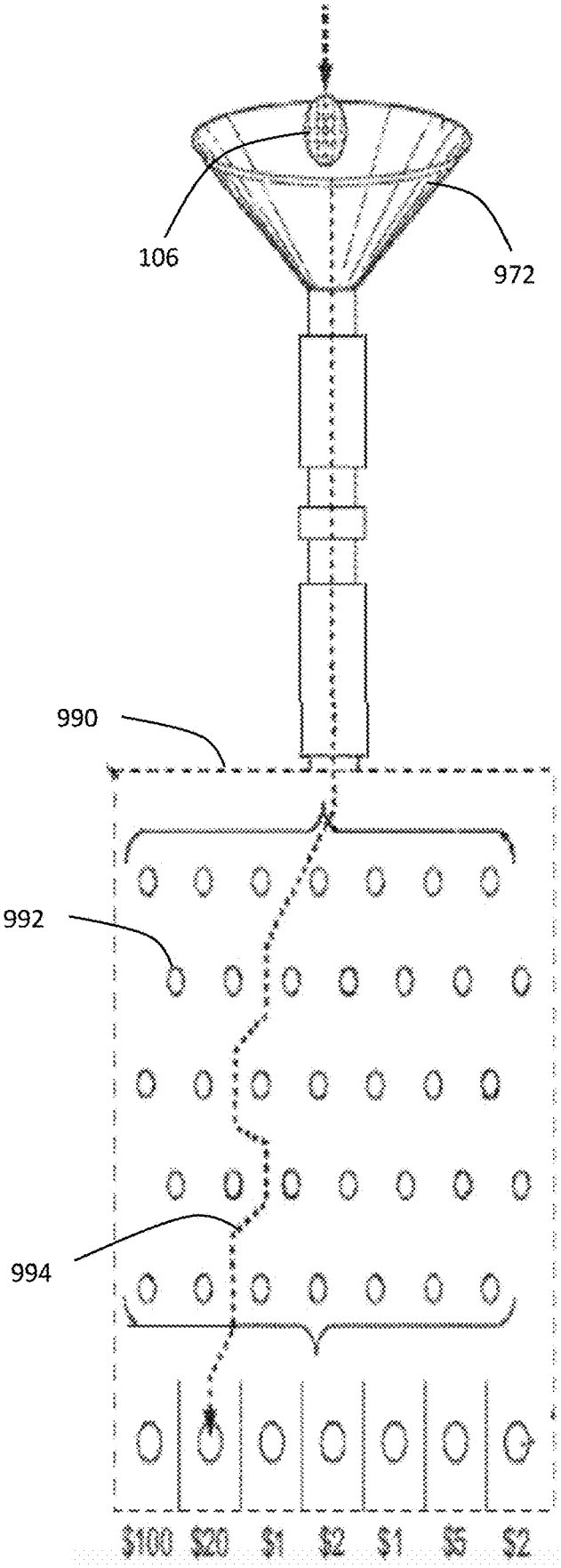
FIG. 13 shows an illustrative mechanical randomizer.

In some embodiments, the target 286 may further include a randomizer 990 as shown in FIG. 13. The randomizer 990 may be located between the target 286 and the target ball acceptor 970, or the randomizer 990 may be included within the target ball acceptor 970. In embodiments where the randomizer 990 is included within the target ball acceptor 970, the randomizer 990 may be located anywhere along the ball path through the target ball acceptor prior to the diverter 982, such as between the single-ball-pass unit 976 and the ball detector 978 or between the target ball identification indicator reader 980 and the diverter 982.

The randomizer 990 provides a random game result for bingo golf game embodiments wherein a target 286 or target area has a random value that changes periodically or may be determined only upon a ball striking the target 286 or target area. The randomizer 990 may be electronic, i.e., a RNG, or mechanical, as in Pachinko. In some embodiments, the randomizer 990 is a mechanical board or other mechanism may be used with the golf ball to reach a random prize. With reference to FIG. 13, there is shown an illustrative embodiment of such a mechanism, wherein the randomizer 990 is a pachinko-style slanted board with obstacles, such as pegs 992, on the slanted board. It shall be appreciated by those of ordinary skill in the art that there are a variety of different gaming apparatus that can be used for the mechanical randomization system.

In operation, a mechanical process may be initiated that has a variety of outcomes that may be mapped into random numbers or prize structures. The mechanical process may or may not involve movement of the ball. In the illustrative embodiment, the ball finds a random path 994 through the slanted board and pegs 992 to an outcome determination level at the bottom. A set of optical sensors, in which each optical sensor is positioned in each prize station, detects a ball 106 and communicates the "hit" back to the server 918 so that the random bingo number or prize can be determined and the player 108 can be informed of the winning amount. A camera (not shown) focused on the slanted board may be used to display the event to the player 108 on the PIU 910 and to record the event for audit purposes. In another example, the golf ball enters a target 286 and falls into a space that allows 2-dimensional movement where the motion of the golf ball 106 is affected by a series of obstacles such as barriers or posts 992 that result in eventually dropping the ball into one of N areas, each associated with a particular prize value. Optical or equivalent detection mechanisms are associated with each prize area so that the server 918 is informed of the prize value, and communicated so that it can be displayed on the PIU 910 and/or other displays in the golf gaming facility.

Each target 286 provides a positive experience for players because the target 286 may include low target areas into which balls 106 may easily roll or bounce. This is good for less-skilled players who might not be able to hit the ball 106 well consistently and would be frustrated by efforts to hit the ball 106 into a higher, smaller target area. Each target 286 may also be highly visible, making it attractive to players 108 because it will be easily visible from a hitting bay or driving space 110. The target 286 may have many different lighting options for evening visibility and entertainment. Different areas of a target 286 may be color-coded and/or lighted to indicate scoring differences. The different target areas may also include mechanical or digital signage to indicate different scoring values associated with different target areas. The target areas may be arranged into tiers having different scoring values for each tier. Such a target configuration can be achieved in a limited amount of space.

When implemented with an embodiment of the dual matrix wagering system 900 which uses RFID as one or the sole means of ball identification, each target area may have a slanted bottom area which gravity-feeds a golf ball to a receptor area 972 of a ball acceptor 970, which includes an RFID reader or sensor 980 and may include a ball separation device 982 and a ball-detector 978 as described above. These may be separate elements, or some of the actions may be combined into units which perform more than one of the functions.

Figure 14:
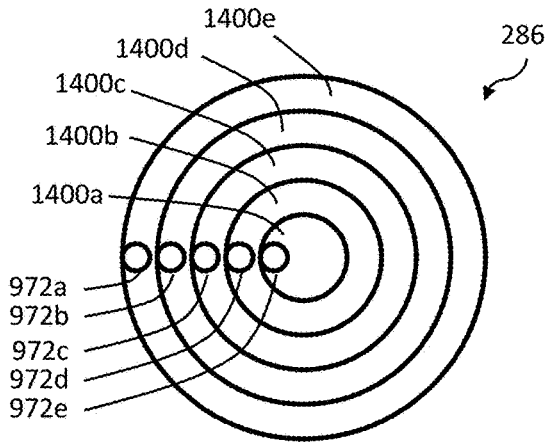
FIG. 14 shows an illustrative target including concentric rings bounding each target area.

An example of a tiered target 286 is shown in FIG. 14. In the illustrative example the tiered target 286 is formed into concentric rings 1400, each of which may have a receptor area 972*a*, 972*b*, 972*c*, 972*d*, and 972*e*, such as a hole or funnel, leading to a ball acceptor 970 and be a different target area 1400. In a further embodiment, the individual rings may be sectioned into parts, each one of which may have a separate scoring value and therefore be a different target area 1400.

Figure 15:
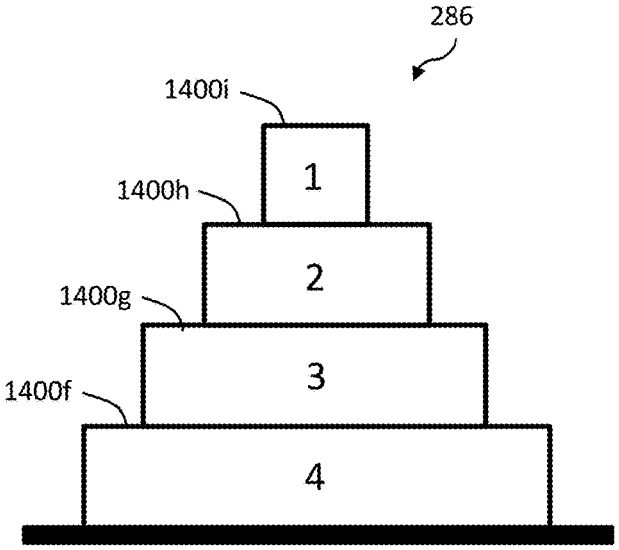
FIG. 15 shows an illustrative target including tiered levels.
Figure 16:
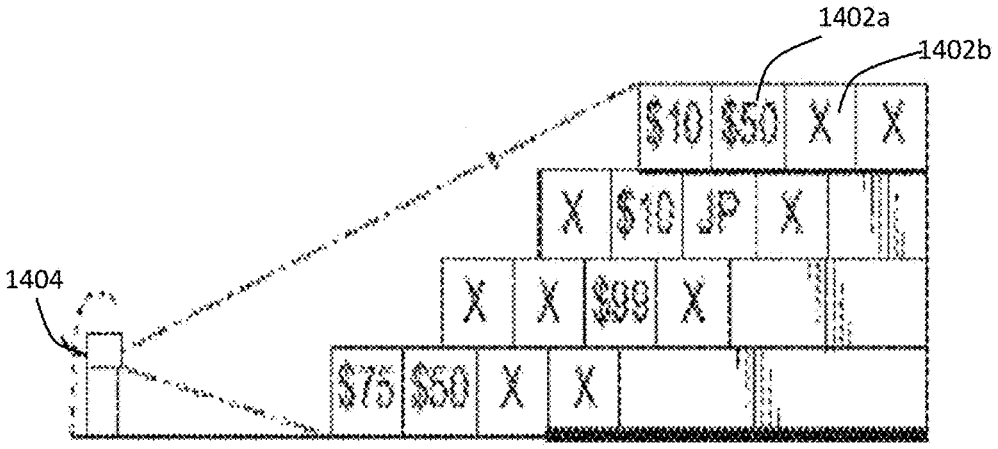
FIG. 16 shows an illustrative tiered target having target areas illuminated by a projector.

Another example of a tiered target 286 is illustrated in FIG. 15. This embodiment is similar in shape to a staircase, with target openings 972 on each step, each step is a separate target area 1400*f*, 1400*g*, 1400*h*, and 1400*i*. Such an embodiment is attractive because the target 286 uses space efficiently and is conducive to different types of signage and lighting. The horizontal step areas 1400 may be further subdivided into multiple target areas 1402, as shown in FIG. 16.

In this example, the game may be modified so that a different prize structure is available to the player, depending on which target 286 or target area 1400 is hit. For example, the prize structure may be as follows:

Target 1—Top prize $10,000; percentage return to player is 98%

Target 2—Top prize $5,000; percentage return to player is 95%

Target 3—Top prize $2,000; percentage return to player is 90%

Target 4—Top prize $1,000; percentage return to player is 85%

In another example, the probability of hitting a target area 1400 associated with a prize, including a progressive prize, can be increased. This increase may be presented in many visual varieties to the player 108 in the presentation of a computerized slot game. In one embodiment, the slot game may include a multi-reel game where a jackpot is won by lining up 5 jackpot symbols. The increased probability may be presented by starting the game play by having some of the reels pre-set with a jackpot symbol and only spinning the rest of the reels. If the game were a 5 reel game, 2 reels could be set to display the jackpot symbol and only the other 3 would have a simulated spin.

In FIG. 16, there is shown an illumination option for a tiered target configuration that includes projection lighting, either using conventional light projection of any type or laser projection. A projector 1404 illuminates the target 286 and target areas 1402, in so doing the light pattern cast by the projector 1404 on the target 286 depicts symbols informing players 108 of the prize or game event produced by striking the target 286 or target area 1402. Illustrative target areas 1402*a* and 1402*b* exemplify the possible result of striking a target area 1402. In the illustrative embodiment, target area 1402*a* is illuminated by the projector 1404 with the symbol "$50" indicating that a player 108 striking target area 1402*a* with a ball would be awarded a $50 prize by the dual matrix wagering system 900. In contrast, target area 1402*b* is illuminated by the projector 1404 with the symbol "X" indicating that a player 108 striking target area 1402*b* with a ball would not be awarded a prize.

Figure 17:
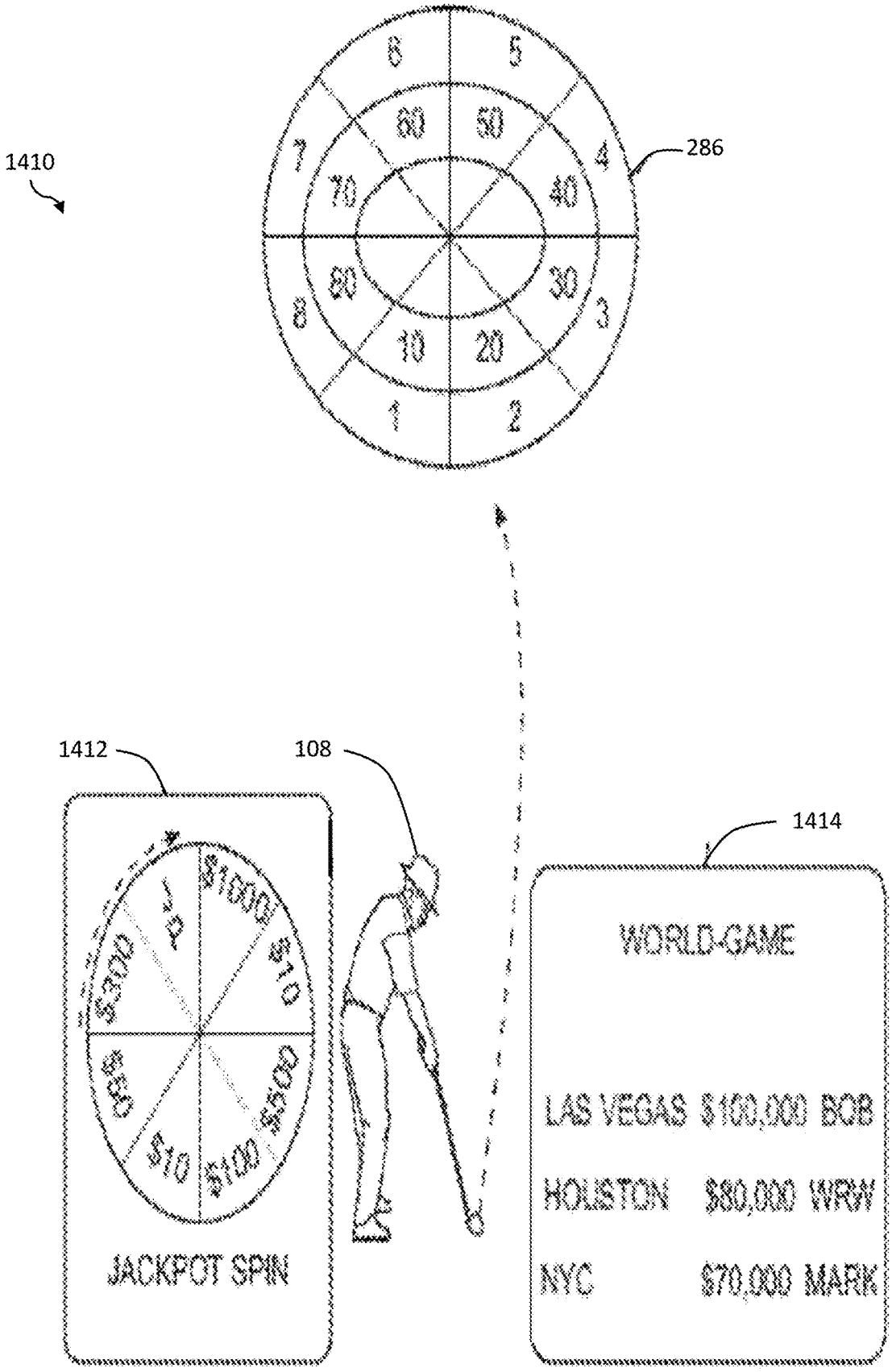
FIG. 17 shows an illustrative world-game.

Referring to FIG. 17 there is shown an illustrative World Game 1410. The illustrative World Game 1410 includes a hole-in-one prize. Upon hitting a hole-in-one, the player 108 may be awarded a wheel-spin 1412 or other chance-based game representation which provides a randomized chance to win a local and/or a wide-area progressive game, or another, very large prize. Presentation of an entertaining animation representing the randomized chance game may be via the display 940 of a PIU 910. A percentage of all World Game 1410 revenue may be allocated to growing the prize in real-time, which prize will be displayed to all participating venues, regardless of where they are located in the world. Displays and currency conversion may be handled by the multi-site progressive controller 924 over the WAN 922. A leader board 1414 is shown on a display indicating large prizes won in the game with the location of win and an optional player identifier. It should be understood that the prize matrix may be changing in real-time so the player 108 does not know where prize values will be when the player 108 strikes the ball 106. In a further embodiment, prizes may be awarded by strings of consecutive hits. Values of consecutive hits may be added to qualify for prizes. In various embodiments, the largest values result in awards of tiers of progressive jackpot prizes.

Figure 18:
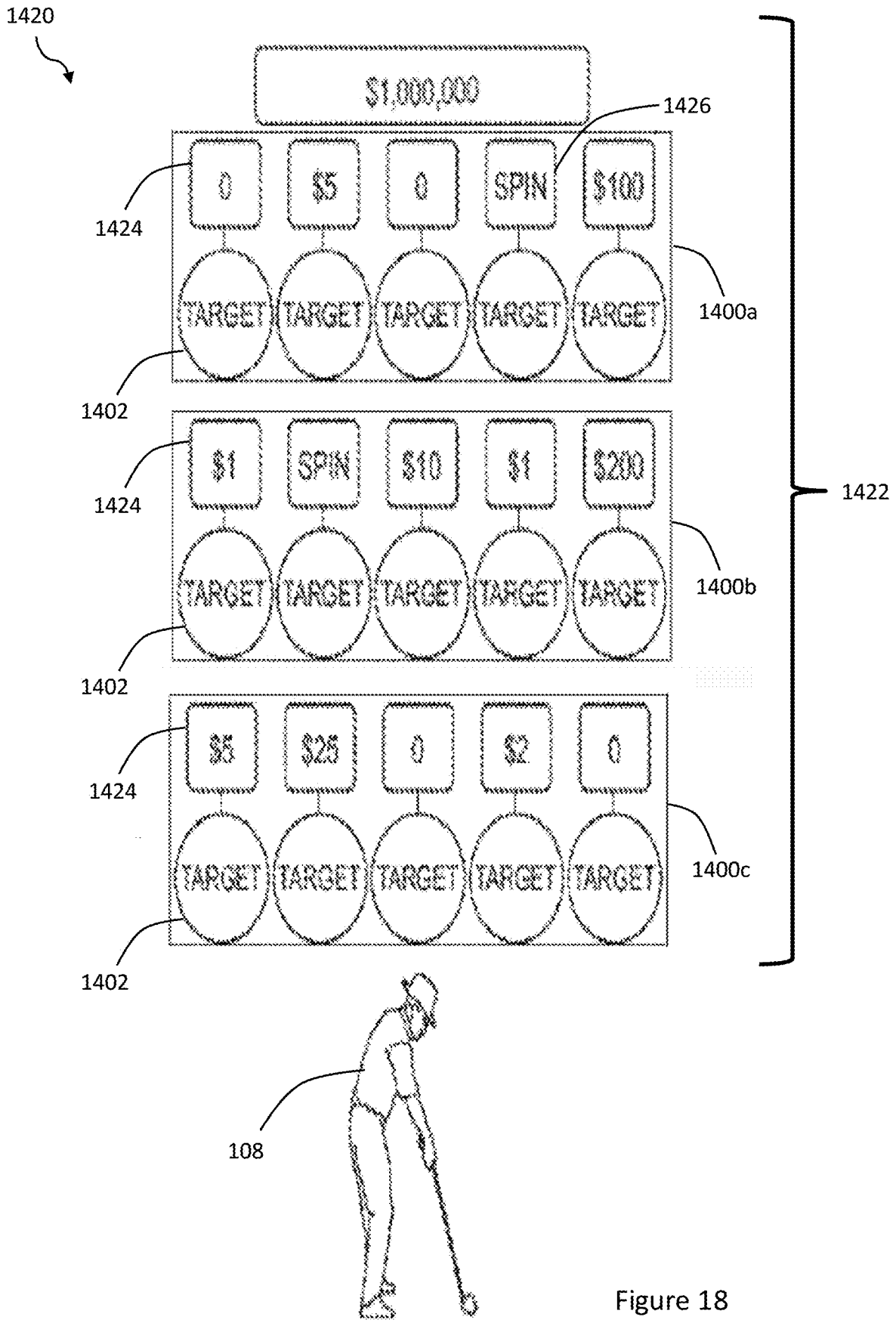
FIG. 18 shows an illustrative matrix game.

Referring now to FIG. 18 there is shown an illustrative matrix game 1420. In this illustrative game, the players 108 hit balls 106 at a matrix of targets or target areas 1422. Each target 286 within the matrix 1422 has a prize value displayed 1424, which is controlled by a computerized controller within or linked to the server 918. Under control of the controller and/or the server 918, the prize matrix 1422 constantly changes in real-time so the player 108 does not know where prize values will be when they strike the ball 106. When the target matrix 1422 changes, the prize values 1424 on a target 286 change, and target areas 1402 may be enabled or disabled. SPIN 1426 indicates a wheel-spin game or other randomized prize award mechanism which provides an opportunity for the player 108 to win a large progressive or non-progressive prize. Other prize values may be fixed award amounts (e.g. $10) or a play of another computer controlled game representation with a variable award.

In one embodiment, the matrix game 1420 is played with matrix 1422 formed from a tiered target having multiple target areas 1402 on each tier 1400, each target area 1402 having a display 1424 above the target area 1402. Each tier 1400 being divided into several horizontal target areas 1402. In various embodiments, the target area display is implemented by a projection system. The projection system is controlled by the server 918, which constantly alters the prize value in each target area 1402 and reflects that change in the display. In various embodiments, an "X" may be displayed over a target area 1402, which indicates that a specific target area 1402 is not active for a prize. By controlling the value and frequency of the target values, a player return percentage may be accurately projected.

Figure 19:
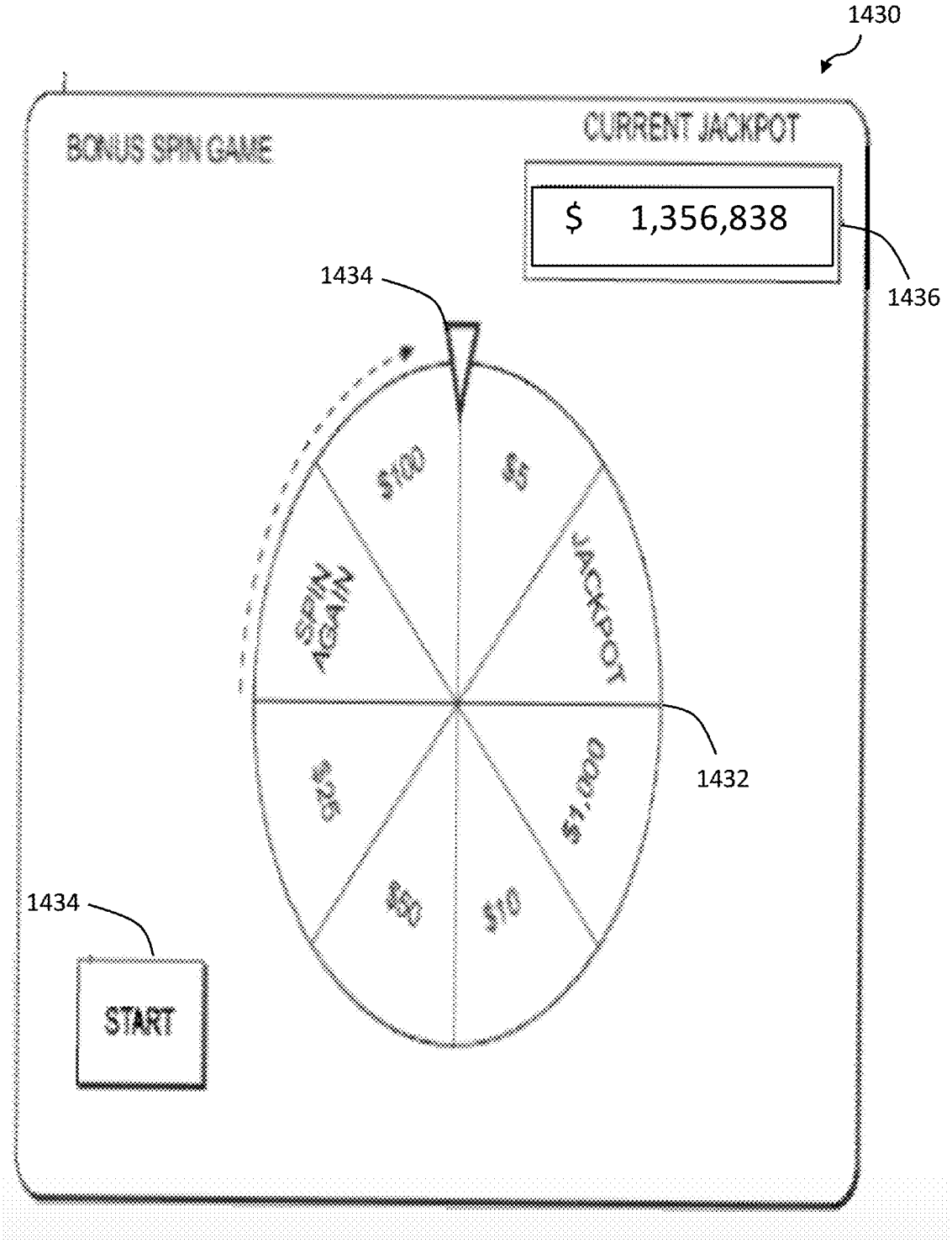
FIG. 19 shows an illustrative embodiment of the display for a progressive bonus spin game.

Referring to FIG. 19, there is shown an illustrative embodiment of a progressive bonus spin game 1430. In operation, the PIU 910 may present an animation of the progressive bonus spin game 1430 on the display 940 in response to a player 108 striking a target 286. In the illustrative embodiment, the progressive bonus spin game 1430 includes a wheel 1432 of prizes, an indicator arrow 1434, a Jackpot indicator 1436, and a start button 1438. Upon completion of the game, the player 108 with the most prizes in a round also gets a percentage of the buy-in of the n players competing across one or more driving ranges sites communicatively coupled through the WAN 922.

Figure 20:
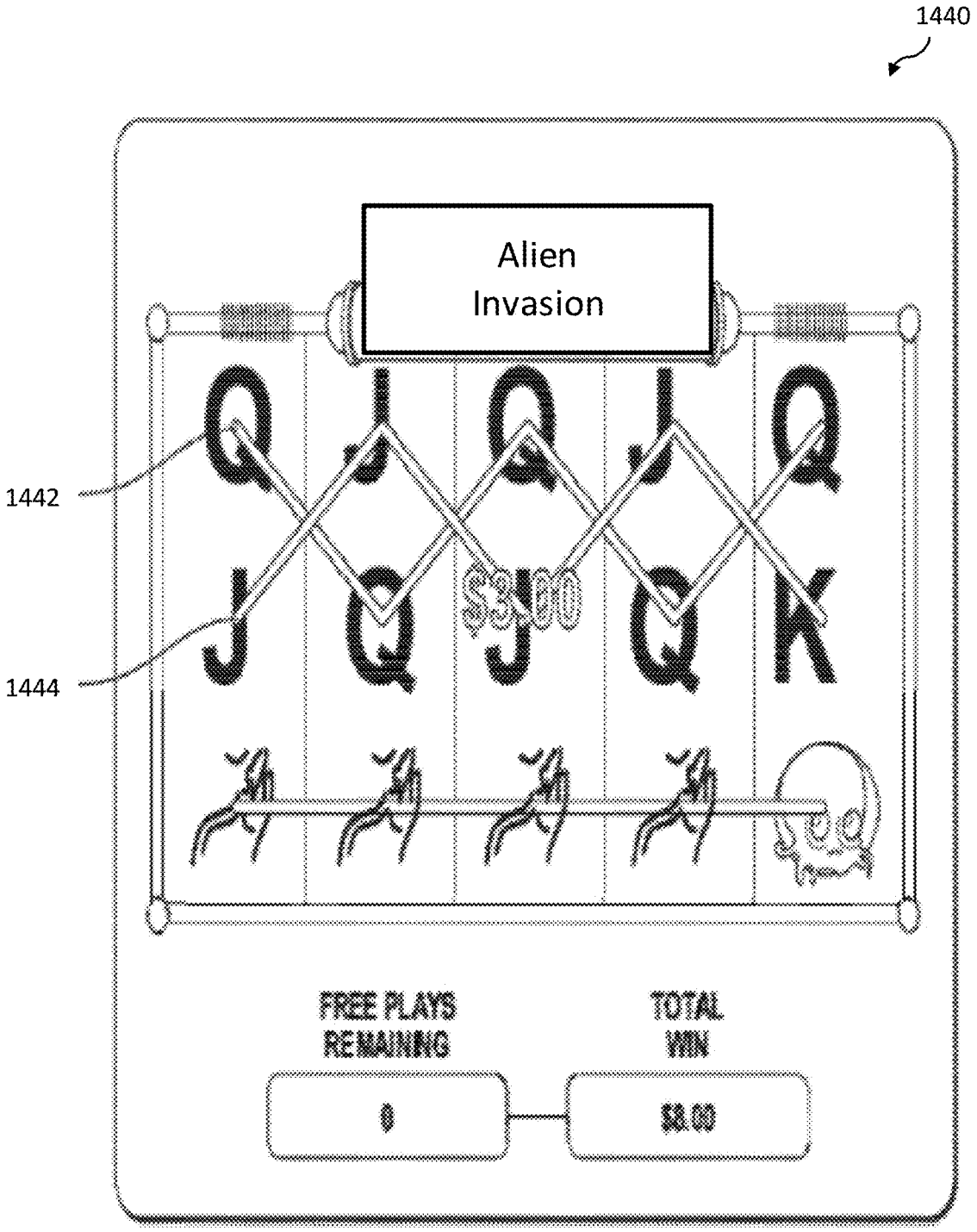
FIG. 20 shows an illustrative example of an entertaining prize display in the form of an Alien slot game.
Figure 21:
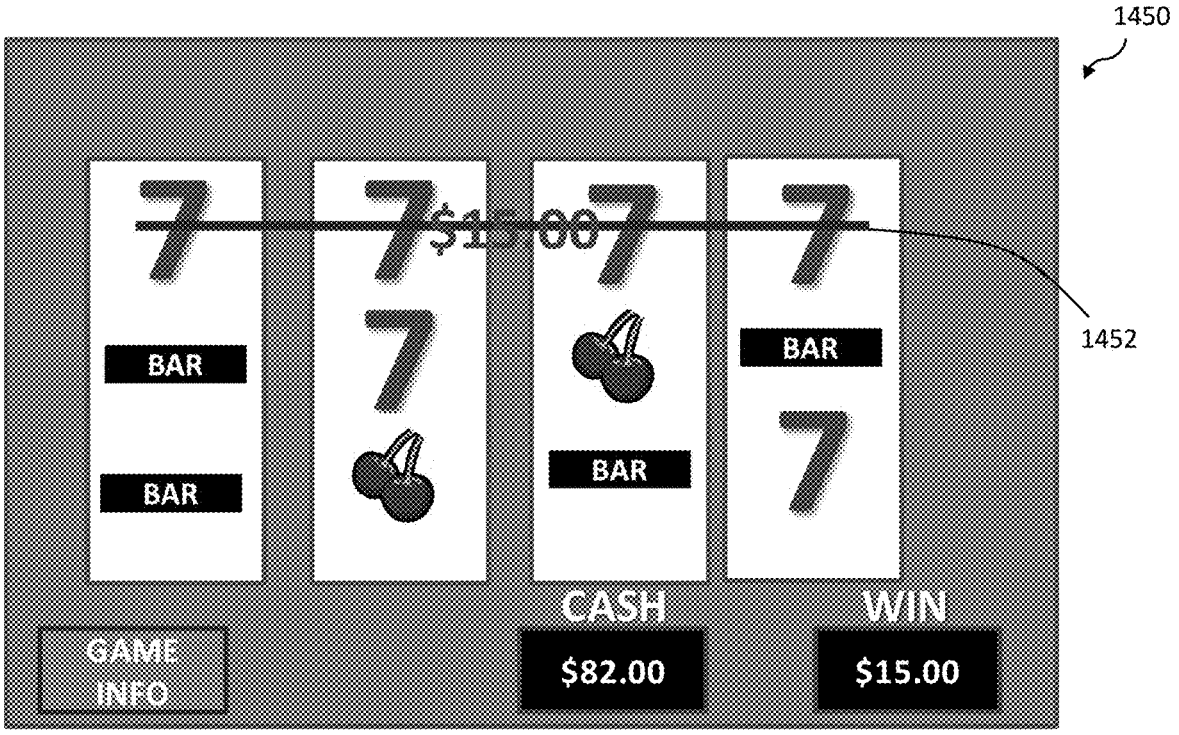
FIG. 21 shows an illustrative example of an entertaining prize display in the form of a Bar 7 slot game.
Figure 22:
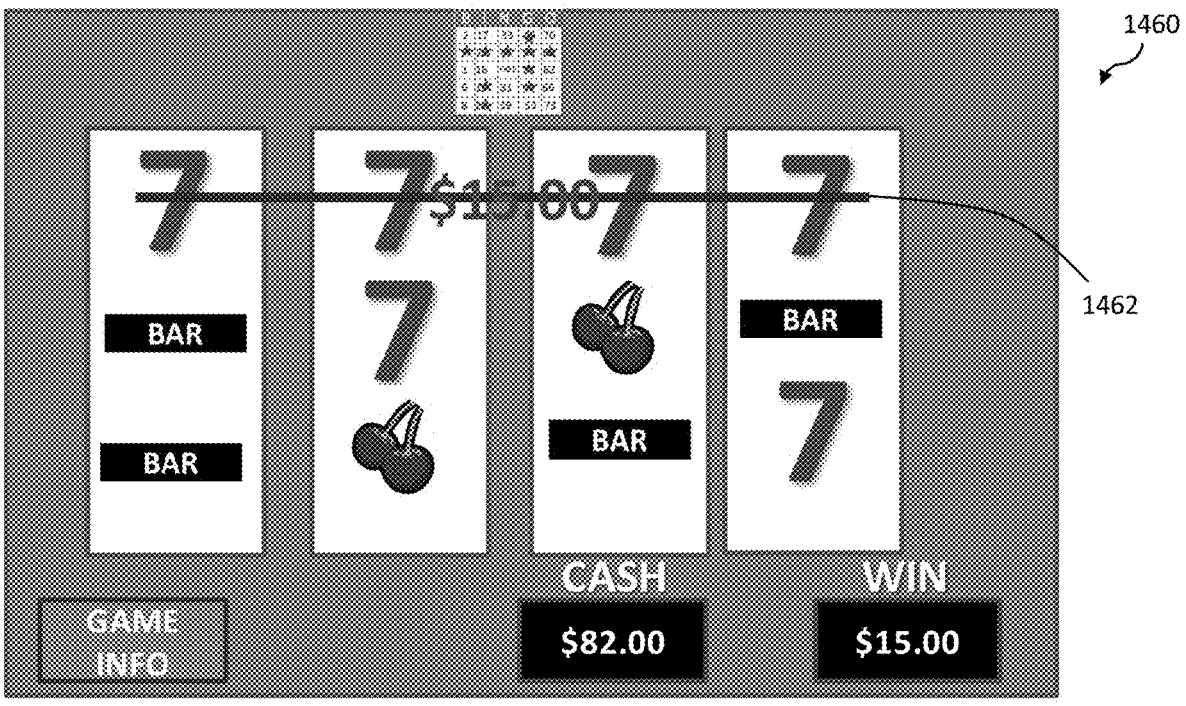
FIG. 22 shows an illustrative example of an entertaining prize display in the form of a Bar 7 bingo slot game.

Referring now to FIG. 20, there is shown another illustrative embodiment of the game of chance, which is a slot game 1440. One form of a game randomization may be represented as a slot machine, which may be initiated when a player 108 strikes a target 286 associated with a particular game theme, or may be one of a set of random games that may be selected by the system or by the player 108. The illustrative slot game 1440 may randomize a game result and derive a payback prize that is a multiple of the wager amount that is specified for the game, and may have been preselected by the player 108. With reference now to FIG. 21, there is shown another embodiment of an illustrative slot game 1450. Referring now to FIG. 22, there is shown an illustrative embodiment of what the player may see displayed for a bonus bingo game 1460.

Figures 23, 24:
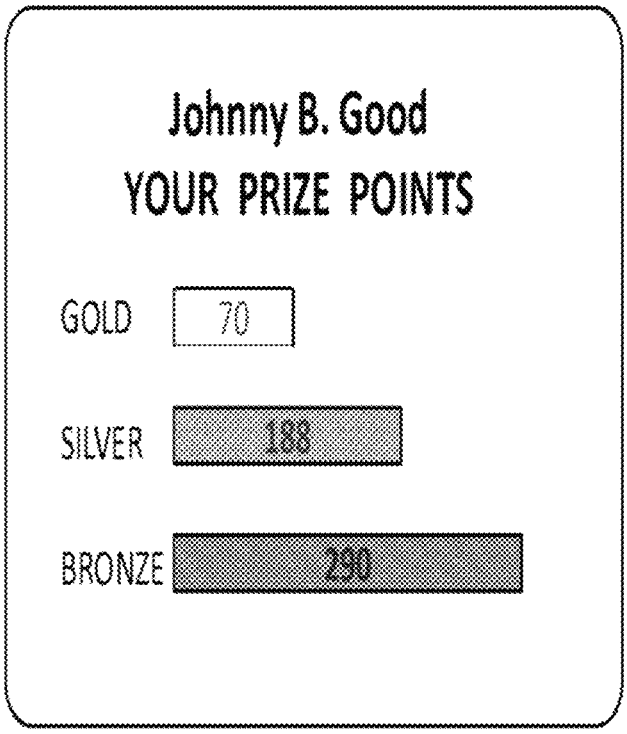
FIGS. 23 and 24 show an illustrative multi-tier prize and point redemption table.

Referring to FIG. 23 and FIG. 24 there is shown an illustrative multi-tier prize and point redemption system. Mechanisms are common to award tokens or points to consumers for participating in certain endeavors. Examples include redemption systems as diverse as skee-ball tickets and frequent-flyer points. In one case the points are awarded as prize elements, in the other, they are awarded for purchasing products. There are many other examples in various programs instituted to promote consumer loyalty to a particular type of activity, brand or association. Typically these programs award points, credits, or tokens which have a uniform definable value. Based on the awarded value, a number of points can be accumulated to redeem or purchase some service or merchandise.

In still other embodiments, a Global Positioning System ("GPS") hardware component is located within the hitting bay or at the driving space 110. The GPS hardware component communicates the bay location to the server 918, which provides real-time confirmation of the facility configuration.

In one embodiment, GPS enabled devices and related positioning technologies are associated with the targets 286 and hitting bays 110. By way of example and not of limitation, GPS may be used in large facilities where there may be a significant difference in distance from one bay to another with respect to hitting a given target. Location technologies may also be important at sites where the targets 286 and/or the hitting bays 110 are mobile. For a mobile target, it is imperative to have accurate distance measurements and corresponding time stamps, which can be an important factor in a case of validating the integrity of one or more large prize hits.

For example, if multiple golf wagering facilities offer a large progressive prize for a hole-in-one target, a minimum distance from tee-to-target would be required for each wagering golf facility. GPS validation of distance may be one requirement to validate the player 108, the golf ball 106, and associate the player 108 with a winning golf ball 106 hitting the target 286.

GPS technologies may also be used with prize schemes where the prize payout is a function of the distance from the tee to the target 286. GPS technologies may be used to calculate the tee-to-target distances in real time, which would make such a prize system easy to create and administer because the prize system would automatically adjust for the different distance to a given target 286 from any of the various driving spaces or hitting bays 110, as well as automatically compensate for target 286 movement.

Figure 25:
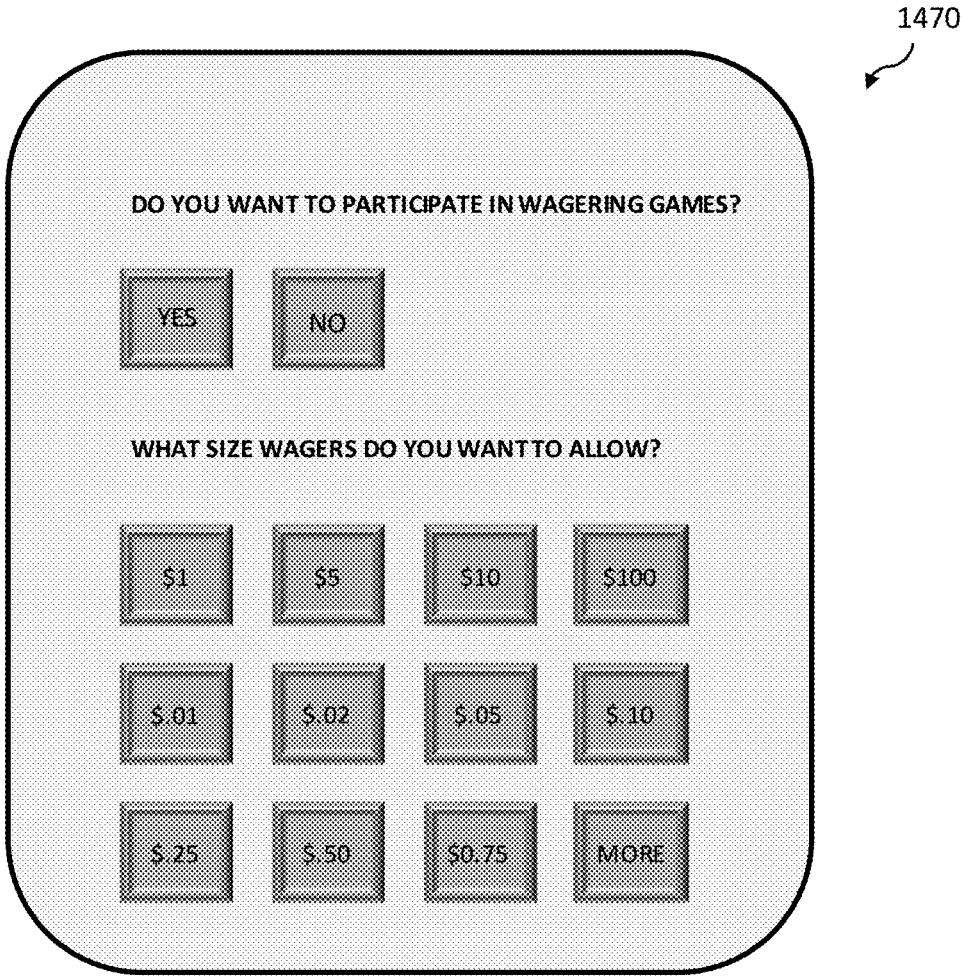
FIG. 25 shows a display screen, including a player prompt and wager selections.

Referring now to FIG. 25, there is shown a prompt screen 1470, in which the player may be prompted with questions on display 940 to decide whether to participate in a wagering game and to set the wager level at which the player 108 wishes to participate. This is especially important if the game is of the positive ID type. In a positive-ID based embodiment, hits on different target tiers 1400 may also initiate different wager amounts, providing more flexibility to a game designer or operator. In one example of such a positive-ID based embodiment, the hardest prize to hit may award a very high jackpot, but require a high wager cost as well.

Additionally, a paytable such as the one presented below specifies possible prizes, and based on a random selection using the probability of each type of prize as a weight, a prize amount will be chosen which will be the Prize Value multiplied by the wager amount.

| Prize Value | Frequency | Probability | Return |
|---|---|---|---|
| 1,000.00 | 100 | 0.0001000 | 100,000.00 |
| 500.00 | 1000 | 0.0010000 | 500,000.00 |
| 250.00 | 100 | 0.0001000 | 25,000.00 |
| 125.00 | 57 | 0.0000570 | 7,125.00 |
| 75.00 | 999 | 0.0009990 | 74,925.00 |
| 50.00 | 400 | 0.0004000 | 20,000.00 |
| 25.00 | 200 | 0.0002000 | 5,000.00 |
| 15.00 | 1000 | 0.0010000 | 15,000.00 |
| 10.00 | 1000 | 0.0010000 | 10,000.00 |
| 5.00 | 10000 | 0.0100000 | 50,000.00 |
| 2.00 | 2000 | 0.0020000 | 4,000.00 |
| 1.00 | 103750 | 0.1037500 | 103,750.00 |

-continued

| | | | |
|---|---|---|---|
| 0.50 | 10000 | 0.0100000 | 5,000.00 |
| 0.20 | 1000 | 0.0010000 | 200.00 |
| 0.00 | 868394 | 0.8683940 | 0.00 |
| | 1000000 | 1.0000000 | 920,000.00 |

SUMMARY

| | |
|---|---|
| Sample Size | 1,000,000 |
| Return to player | 920,000.00 |
| % Return to Player | 92.00% |
| Number of Prizes | 131606 |
| Prize Frequency | 13.16% |

An entertaining display will then be presented on display 940 of PIU 910 in hitting bay 110. Display 940 may show a slot-themed game, such as in FIGS. 20, 21, and 22, with entertaining sounds and bonus features such as are well known to those familiar with the art of casino game design. Symbols change on the screen, simulating spinning reels, and stop in a pattern that displays prize values for combinations of symbols in certain lines or other configurations, or, alternatively, in various quantities. An example of such game play is shown in FIG. 20 with a space-themed "Alien-Invasion" game having two winning combinations of symbols: (1) Q-Q-Q-Q-K on payline 1442; and (2) J-J-J-J-K on payline 1444. A further example of such game play is shown in FIG. 21 with a classic "Bar 7's" game having a winning combination of symbols: 7-7-7-7 on payline 1452. Yet a further example of such game play is shown in FIG. 22 with a "Bar 7's Bingo" game having a winning combination of symbols: 7-7-7-7 on payline 1462.

In some embodiments, the skill portion of a game session may have multiple steps, requiring multiple ball hits successfully landing in one or more targets 286. The game might involve the generation of a numeric value, and several game play events result in the sum of numeric values and a final prize value may be dependent on the sum of those numbers.

In another embodiment, a game includes a random process that is a mechanical process rather than an electronic process, such as in FIG. 13.

Another illustrative embodiment combines a skill element with a game of chance in a gambling game. The skill element may be used to increase or modify the probability of winning prizes in the game of chance. One example is a game in which golf balls are aimed at a group of targets 286. Upon successfully hitting a target 286, a computerized game is initiated which has various prize levels. More difficult targets may offer a higher probability of winning the jackpot, a higher prize value, a higher overall prize return percentage to players and/or different wager amounts for play.

Yet another embodiment of the dual matrix wagering system 900 combines a skill element with a game of chance in a gambling game. The particular odds and format of the game are tailored for a particular player 108. The particular player 108 may be identified through facial recognition, a player ID card, or other means. In this embodiment, the game tracks the play of the particular player 108 and adjusts future prize structures or payout percentages based on past play. For example, adjustments can be on a per-day, per-play, or other measure based on changing player capabilities over time. This information can also be used to categorize players under a skill level matrix, combined with other player attributes or identifiers, so that the players might be eligible for awards, promotions, prizes or other incentives.

One technique to enhance the interest of randomized prize golf games where payment is made on striking a golf ball 106 without requiring a target hit is to award certain prizes even when targets are missed. An algorithm may be applied that heuristically measures the incidence of target hits to misses and may introduce random small prize games when the ratio is very low. This can be done to bring the payout up to a minimum threshold level. This may keep less skilled golfers from becoming discouraged and will encourage more players to participate.

Figure 26:
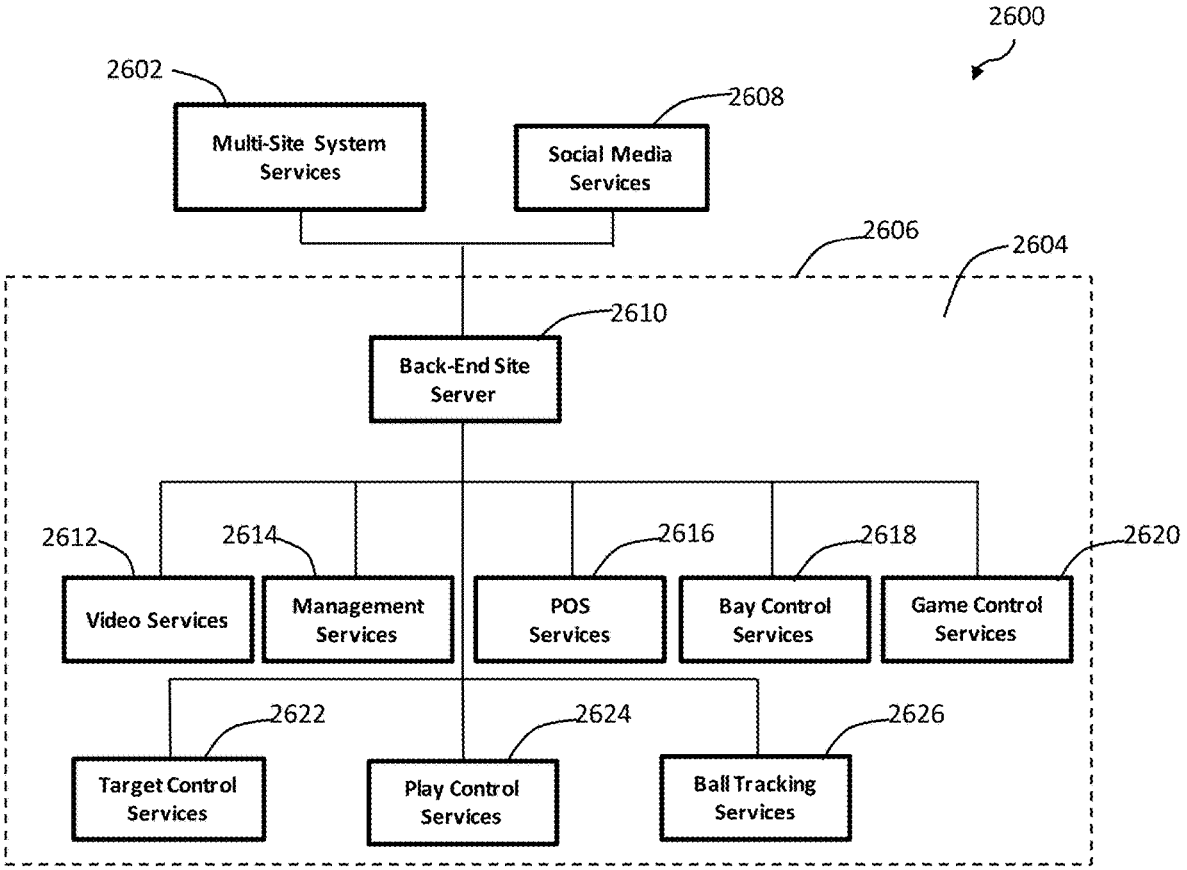
FIG. 26 shows an illustrative software architecture configured to perform the operations associated with the dual matrix wagering system.

Referring now to FIG. 26, there is shown an illustrative software architecture 2600 configured to perform the operations associated with the dual matrix wagering system 900. The illustrative software architecture 2600 includes a multi-site system services module 2602 and a local site services module 2604. The multi-site system service module 2602 is presented outside the site service boundary 2606 that provides an illustrative boundary condition of the site services module 2604.

The illustrative multi-site system services module 2602 supports the services for multiple operational sites or facilities, in which each operational site may include a site services module 2604. Thus, the multi-site system services module 2602 performs specific services for multiple operational sites. By way of example and not of limitation, these multi-site services may include a software management module associated with at least one wide-area progressive prize, a first database for player prize points, a second database that includes a plurality of merchandise prizes that may be purchased with player prize points, a prize software module that includes one or more access functions that enable each player to access information corresponding to prize points and redeeming prizes. Additionally, the multi-site system services module 2602 may also include a database of information regarding the operational and financial performance of individual sites.

An illustrative social media services module 2608 is also disposed outside the site service module boundary 2606. In the illustrative embodiment, the social media services module 2608 is also communicatively coupled to at least one of the site services modules 2604. In one illustrative embodiment, multiple elements of the site services module 2604 and the dual matrix wagering system 900 may also have access to social media services module 2608. By way of example and not of limitation, the social media services module 2608 is configured to interface with social networks such as Facebook, Twitter, Instagram and other such social media networks. In operation, the social media networks provide a platform to distribute content associated with the dual matrix wagering system 900, the illustrative golf facility operating the golf wagering system 900, the multi-site system service module 2602, one or more of the site services module 2604, and other such systems or modules that communicate content to a social media network.

In an illustrative embodiment, the multi-site system service module 2602 and the site services module 2604 may be accessible on the WAN 922, e.g. the Internet, through common desktop or mobile browsers such as Internet Explorer, Chrome, or other such browsers. The multi-site system service module 2602 and the site services module 2604 may also be accessible through the PIU 910. In another embodiment, the multi-site system service module 2602 and the site services module 2604 may be accessible through an "application" that is loaded on a personal computing device such as a tablet computer, a smartphone, a virtual reality goggle and other such personal computing devices. Additionally, certain aspects of the multi-site system services 2602 may only be accessed by authorized components of one or more of the site services modules 2604.

The site services module 2604 includes a back-end site server 2610 that may be located on site at the driving range facility or on a remotely located operational site, in a co-hosting location, in a cloud-based facility or in any other such computing facility. The location of the back-end site server 2610 may be based on the system design constraints such as cost, reliability, security, throughput and response time. The back-end site server 2610 may also be embodied as a suite of multiple servers.

The back-end site server 2610 stores and processes the operational site data. For example, the storage capabilities of the back-end site server 2610 include database structures utilized for financial and operational needs. In one illustrative embodiment, the back-end site server 2610 includes detailed site financial data and performs management of all player financial play sessions. In another illustrative embodiment, the back-end site server 2610 stores and processes historical information on player activity and aggregates statistical information on all game play and games. Additionally, the back-end site server 2610 logs system activity, game activity and configuration data on the system, including target location data. Furthermore, the back-end site server 2610 may host multiple software applications for management of the site operation, including human resources and employee scheduling. Further still, the back-end site server 2610 may be embodied as one or more virtual servers that may be associated with a cloud service such as Amazon Web Services or Microsoft Azure.

The back-end site server 2610 may include or be communicatively coupled to a video services module 2612. The video services module 2612 manages video-specific information such as the site-wide video resources that include certain monitors in the hitting bays 110, large monitors in multiple locations in the facility, monitors in restaurants, monitors in the target range, monitors in reception areas and in any other locations where it may be desirable to display information to players 108. The video services information managed by the video services module 2612 may include promotional information for the site, advertising, winner recognition, player bonus play, informational videos, and other such video information. Additionally, video services may include information regarding active game play, leader boards, reward structures and payouts.

Also, the back-end site server 2610 may include or be communicatively coupled to a management services module 2614 that will provide access to the information and operational functions necessary for site operation. The management services module 2614 allows employees to access operational sub-systems according to applicable security protocols and sub-system operational parameters. The management service module 2614 may also provide access to financial and operational history information, as well as the ability to configure the operational aspects of the system.

A POS services module 2616 may also be communicatively coupled to the back-end site services module 2610. The POS services module 2616 is operatively coupled to kiosks or cash registers disposed at retail points and POS stations 912 described in FIG. 9. By way of example and not of limitation, the kiosks or cash registers may be used to create player accounts, add funds to player accounts, provide refunds, and perform other player service functions.

The back-end site server 2610 may include or be communicatively coupled to a hitting bay control services module 2618. The bay control service module 2618 may be processed or managed by each PIU 910, a hitting bay server (not shown), or any combination thereof. The bay control services module 2618 manages player activity in each hitting bay 110. Additionally, the bay control services module 2618 coordinates the operations associated with player accounting, selection of games, display of play and game information in the hitting bay 110, initiating and monitoring of ball dispensing, reporting play results, accepting additional player funds and other such bay control operations. The bay services module 2618 may also coordinate the activities associated with the ball dispenser 934, the game control services module 2620, player display embodied in the PIU 910, user interface 936, input from player identification devices, such as card readers and smart-phones, and the play control services module 2624. Additionally, the bay services module 2618 may also recognize the initiation of game play.

The back-end site server 2610 may include or be communicatively coupled to the game control services module 2620, which is configured to support a suite of game modules corresponding to a variety of games that players 108 will be able to select in the hitting bays 110. The games may include many types of entertainment and wagering games. Each type of game will have different video presentations and may, in the case of wagering games, be associated with different pay-tables and use the services of a secure RNG to produce game results which may be the hybrid result of the results of a skill-based event and the random results based on one or more RNG results. Additionally, the game control services module 2620 may also display ongoing game progress and competitive position for live/active play. Furthermore, the game control services module 2620 compiles historical play information to update odds and percentages for an on-going game.

The back-end site server 2610 may include or be communicatively coupled to a target control services module 2622. The target control services module 2622 manages activity corresponding to one or more targets 286 and, further, makes determinations associated with target hits. The target control services module 2622 may also perform functions that include controlling or communicating with the tracking module, which may include a plurality of optical detectors that determine when a ball has entered the target 286. The target control services module 2622 also has the ability to access enhanced logic, such as the intelligent analysis method described herein, that determines the source of a ball 106 entering the target 286, even if the RFID of the ball 106 cannot be read. Furthermore, the target control services module 2622 may be configured to divert a ball with an unreadable RFID to a holding area for removal from the dual matrix wagering system 900. Further still, the target control services module 2622 may be configured to isolate a ball 106 that has been determined to have won a high-value prize for prize validation or security purposes. Further yet, the target control services module 2622 may also determine, recalibrate and confirm location of targets 286 in relation to the player 108. Further still, the target control services module 2622 provides critical information such as distance, slope and other such information which would be particularly significant to mobile targets.

The back-end site server 2610 may include or be communicatively coupled to the play control services module 2624. The play control services module 2624 provides the detailed management for the devices associated with receiving and hitting a ball 106, which includes the detection of the player 108 requesting the ball 106, such as by the player identification device 938 of the PIU 910, the validation that the ball 106 to be dispensed has a valid unique identification indicator, such as an RFID, the diversion of a ball with an unreadable unique identification indicator, such as an RFID, to a holding area for removal from the system, and the dispensing of the ball to the player 108 by the dispenser 934. Additionally, the play control services module 2624 associates and tracks a player 108 and the player's activity with a play object.

The back-end site server 2610 may include or be communicatively coupled to a ball tracking services module 2626. The ball tracking services module 2626 stores, manages or controls ball information that includes measurable ball attributes such as horizontal angle of hit, vertical angle of hit, ball speed, ball spin, and ball location from the time of the ball is hit until the flight of the ball concludes. The ball information may also include generation of directional information on the flight of the ball to enter into calculations of probable target impacts. Depending on details of system implementation, information sources for the calculations can come from one or more of the following sources: Dual-matrix data, Doppler radar, video images, laser tracking devices, or any combination thereof. Additionally, the ball tracking services module 2626 also tracks key information regarding timing for flight of the ball for verification and legitimacy of game play.

It will be appreciated by those of skill in the art that there are multiple ways of implementing the software systems and methods described above. For example, the dual matrix wagering system 900 and corresponding software architecture may be embodied in a dedicated local computer or microprocessor or may be embodied in a local server, a virtualized server, a remotely hosted server, a cloud-based service provider, such as AWS and Azure, and any other such source. The software modules may also be embodied in a client-server system, a peer-to-peer system, a hierarchical computing system or any combination thereof. Communications between the various electronic and computing systems may be performed using LAN communications, WAN communications and other viable communication methodologies, including serial or parallel data transfer, Bluetooth, NFC and other such technologies.

Figure 27:
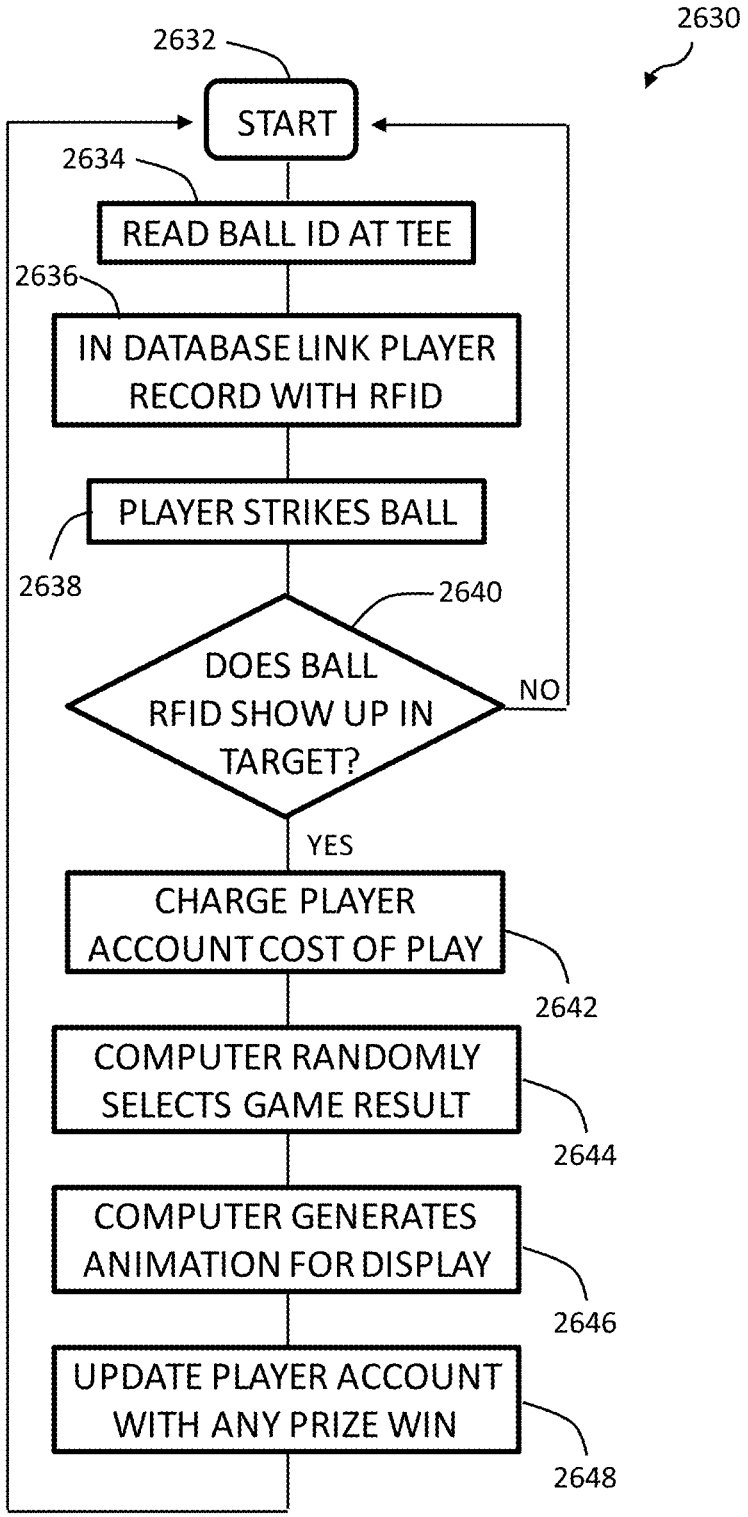
FIG. 27 shows an illustrative method for interacting with an illustrative dual matrix wagering system.

Referring now to FIG. 27, there is shown a method for performing an illustrative dual matrix wagering game. The method 2630 is initiated at "start" 2632. At step 2634, a player 108 sets a ball 106 in the driving space 110 and an RFID reader reads the unique RFID from the ball 106 and associates that ball 106 with the particular player 108.

At step 2636, the ball 106 is then linked to the player record with the particular RFID code in database 920. At step 2638, the player 108 strikes the ball 106 from the mat 930 while in the driving space 110, putting the RFID golf ball 106 into play. A decision point is then reached at step 2640. If the ball lands in target range 904, but not in a target 286, the process returns to start step 2632. In that case, the ball is collected from the target range 904, reset and made available for replay. If the ball 106 lands in a target 286, the process moves on to step 2642.

At step 2642, the player's account is charged for the cost of hitting the target 286 and a game of chance is initiated in the form of a wager on the randomization game. At step 2644, a random game result is selected. At step 2646 a game animation is generated and shown on display 940 for the player to view and enjoy. Several such game animations are depicted in FIGS. 19 through 22.

At step 2648 the system is updated with play information necessary for audit controls, and the player account is updated to reflect play data and any winning prize amount.

Figure 28:
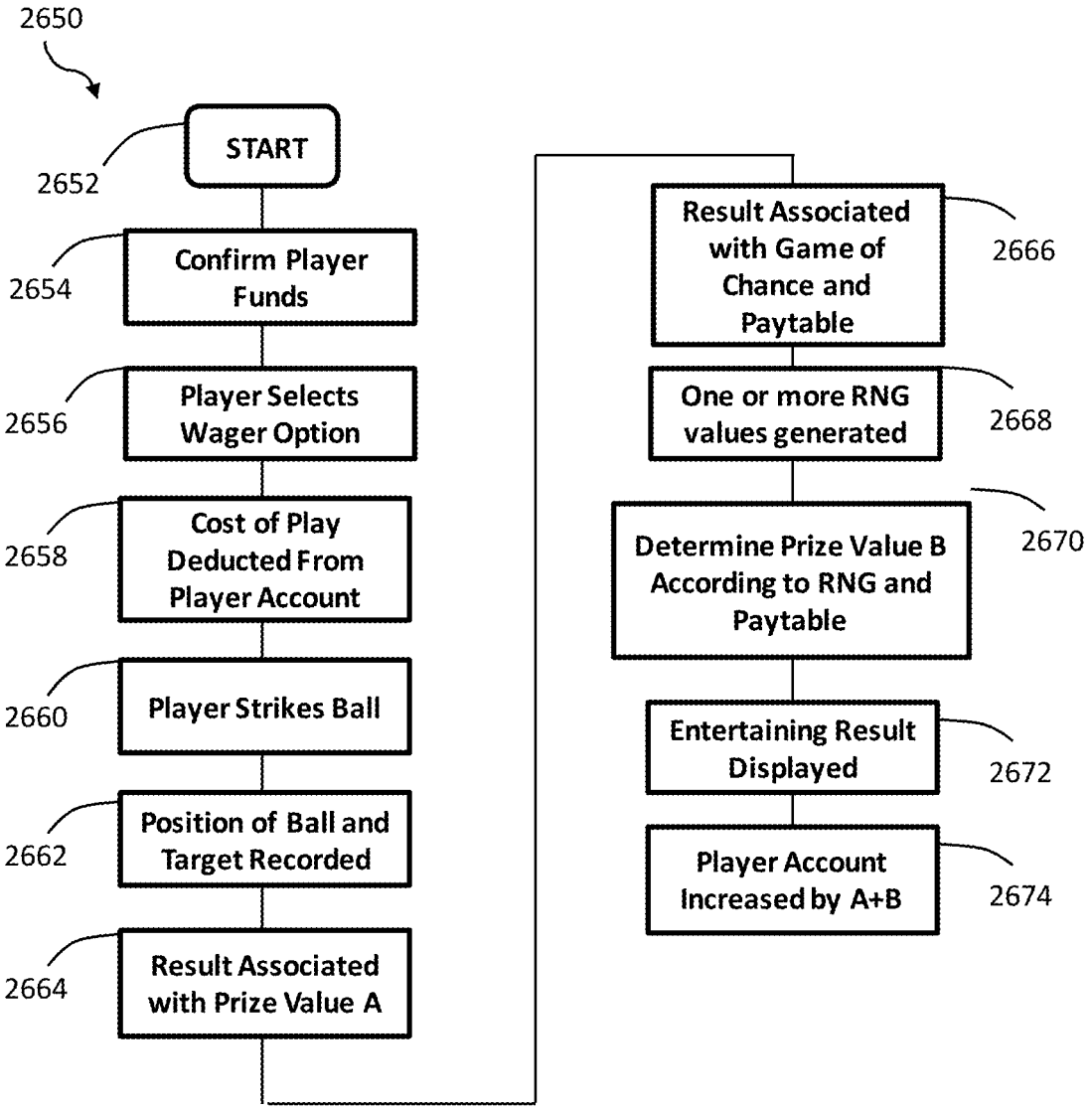
FIG. 28 shows a further illustrative method for interacting with the illustrative dual matrix wagering system.

With reference to FIG. 28, there is shown a further method of operating a golf wagering system 2650. The player 108 starts 2652 the method by interacting with the PIU 910. At step 2654, the system then confirms that the player 108 has funds in an account linked to the player 108. If there are insufficient funds, the player 108 will be prompted to transfer funds into his account, and play will not begin until the player 108 has done so. The player 108 will have the opportunity to set certain wagering options before play at step 2656. These options may include setting a wager denomination and specifying a particular choice of entertainment display, i.e. a game selection. Upon receiving the player selection, at step 2658 the system deducts the cost of the play from the player's account.

At step 2660, the dispenser 934 provides a ball 106 to the mat 930 and the player 108 strikes the ball 106. The ball is linked to the player record with the particular RFID code in the database 920. The result of the ball flight towards the target 286 is recorded in step 2662 by the dual matrix apparatus 100. At step 2664, a primary prize amount, A, is recorded for the play. The primary prize amount, A, is based on the result of the ball flight towards the target 286. In various embodiments, the primary prize amount, A, may be a function of the identification of the particular target involved, the proximity of the ball hit to the target 286, the distance of the target 286 from the hitting bay 110 and other factors that may be associated with the target 286 and associated parameters. The primary prize amount determination may also vary by day of the week, time of day, pre-scheduled promotions, and other factors as determined by game designers and facility managers and supported by the management software in the system.

At step 2666, the target result may be a game of chance having any one of a number of different pay-tables that are associated with the various target results. In various embodiments, the game of chance and pay-table selection may be the result of prior play. In one embodiment, the available prize pay-table may vary in a well-defined way based on prior play history. At step 2668, an RNG generates one or more random numbers, facilitating game play corresponding to the particular game of chance and pay-table. In this manner, the game of chance is implemented in any one of a number of ways in step 2668. In various embodiments, the game of chance is implemented as a slot-machine model, where the RNGs may be used to calculate random positions of multiple reels with slot symbol positions. At step 2670, a resulting symbol matrix may then be used to calculate a winning prize value B. In various embodiments, the prize value may be determined using an RNG and a table of prize values with associated probabilities. In still other embodiments, the player 108 may be engaged in a bingo game, either with another player or players in the same facility or in different facilities. As a result of the bingo game the player 108 will have a determined prize value. At step 2672, the determined prize value is displayed to the player 108 by the PIU 910. The result display may present an entertaining animation with a combination of symbols which allows calculation of a prize that equals the predetermined value. No matter the embodiment, at step 2672 the player 108 sees an animated matrix of symbols and a prize result displayed with interesting visuals, sound, and anticipation. The method terminates at step 2674, where the player account is updated with any winning amounts representing the primary and secondary prize win total. Note that in some cases they can be separately displayed, and in other cases combined, depending on a desired game presentation of the game design.

Figure 29:
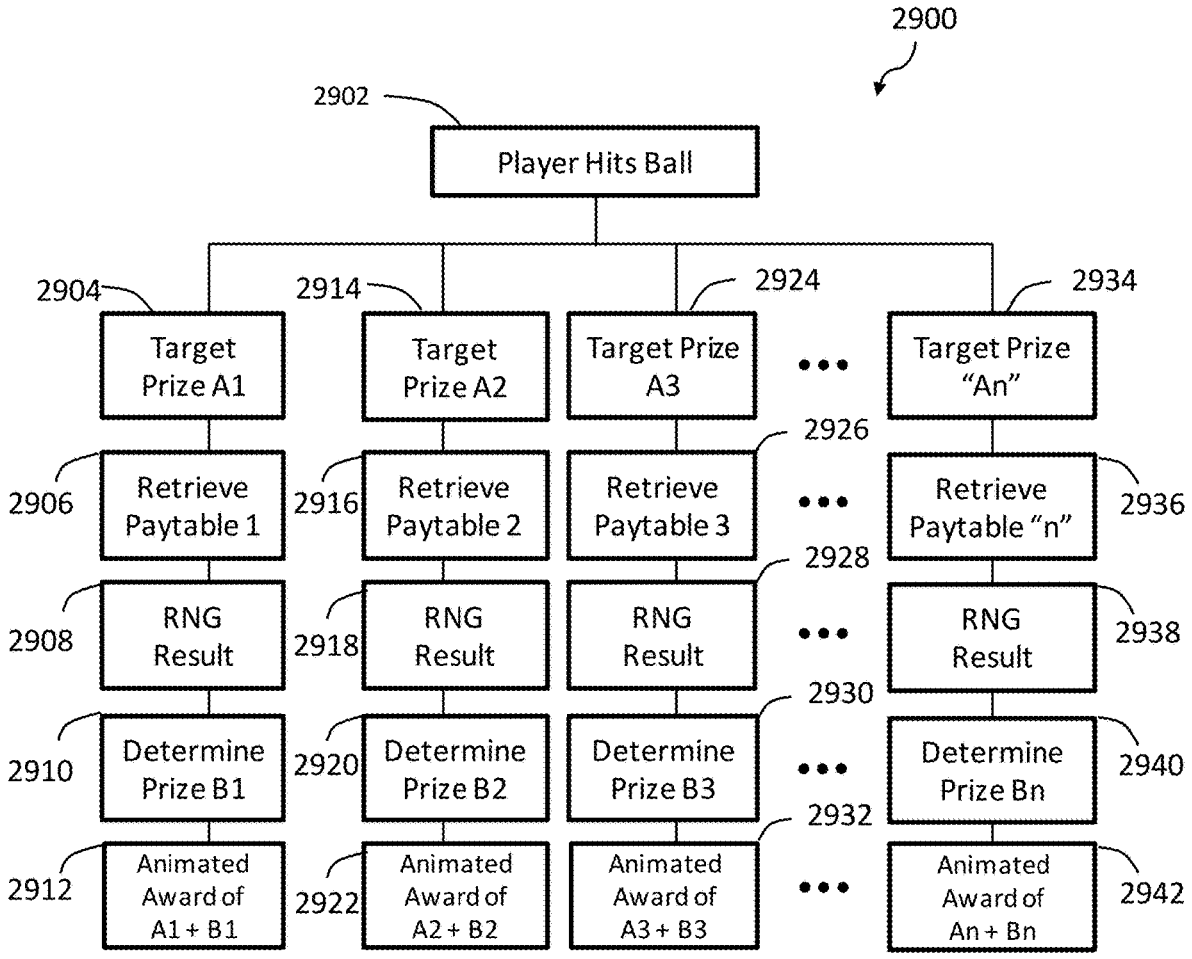
FIG. 29 shows an illustration of the relationships between the result of a target hit and the subsequent prize determination and entertaining result display.

With reference now to FIG. 29, there is shown an illustrative flow chart 2900 of game events triggered by successful player 108 target hits. The following game events and operations described herein may be performed by the server 918, the PIU 910, the control unit 112, the target control 974, or any combination thereof. The flow chart 2900 begins with a player 108 hitting a ball 106 at block 2902. Where the player 108 strikes exemplary target 1 at block 2904, the system credits target prize A1 to the player 108. At block 2906, the system retrieves associated pay-table 1 from the database 920. In some embodiments, the dual matrix wagering system 900 retrieves pay-table 1 from the database 920 over the LAN 914. The dual matrix wagering system 900 then generates a random number associated with a random game result through electronic or mechanical methods at block 2908. The dual matrix wagering system 900 uses the random number result and pay-table 1 to determine a second prize B1 that is credited to the player 108 at block 2910. The method terminates by displaying an entertaining animation wherein the player 108 is awarded prize A1 and B1 at block 2912.

Where the player 108 strikes exemplary target 2 at block 2914, the dual matrix wagering system 900 credits target prize A2 to the player 108. At block 2916, the dual matrix wagering system 900 retrieves associated pay-table 2, which is different from pay-table 1, from the database 920. The dual matrix wagering system 900 then generates a random number associated with a random game result through electronic or mechanical methods at block 2918. The system uses the random number result and pay-table 2 to determine a second prize B2 that is credited to the player 108 at block 2920. The method terminates by displaying an entertaining animation wherein the player 108 is awarded prize A2 and B2 at block 2922.

Where the player 108 strikes exemplary target 3 at block 2924, the system credits target prize A3 to the player 108. At block 2926, the system retrieves associated pay-table 3, which is different from pay-table 1 and pay-table 2, from the database 920. The system then generates a random number associated with a random game result through electronic or mechanical methods at block 2928. The system uses the random number result and pay-table 3 to determine a second prize B3 that is credited to the player 108 at block 2930. The method terminates by displaying an entertaining animation wherein the player 108 is awarded prize A3 and B3 at block 2932.

Thus, the method 2900 may extend for "n" number of targets 286, each associated with a pay-table and a prize. In various embodiments, the pay-table associated with each target 286 may be unique and distinct from all other pay-tables. In further embodiments, there may be tiers of targets all having the same or similar pay-tables, thereby reducing the complexity of the game. By way of example, where the player 108 strikes target n at block 2934, the dual matrix wagering system 900 credits target prize An to the player 108. At block 2936, the system retrieves associated pay-table n from the database 920. The dual matrix wagering system 900 then generates a random number associated with a random game result through electronic or mechanical methods at block 2938. The dual matrix wagering system 900 uses the random number result and pay-table n to determine a second prize B3 that is credited to the player 108 at block 2930. The method terminates by displaying an entertaining animation wherein the player 108 is awarded prize An and Bn at block 2932.

In one embodiment, a game session begins when a golf ball 106 with a unique identifier is delivered or dispensed to the driving space 110. The ball ID and driving space 110 to which the ball 106 is delivered are recorded in the database 920. The player 108 strikes the golf ball 106 from the driving space 110. The time of ball strike, as well as ball trajectory information are detected and recorded by the dual matrix tracking apparatus 100 and stored in the database 920. The struck ball 106 then travels to a target 286 located in a target range or a golf driving range 904, a golf course, a gaming establishment, such as a casino, or any such location that can house a hitting bay or driving space 110. Upon arriving at a target 286, the ball 106 is detected by the ball identifier module 906, the ball identifier is read, if possible, by the ball identifier module 906. The ball arrival time and associated identifier are recorded in the database 920. The server 918 then determines the player 108 responsible for the target strike from the information recorded in the database 920, and initiates a secondary game of chance corresponding to the particular target 286 struck. A random game event determines the outcome of a game of chance, and the player 108 is awarded the first prize and any second prize through an entertaining animation presented on the PIU 910.

In various embodiments, the server 918 includes a primary prize calculator (not shown) and a secondary prize calculator (not shown). The primary prize calculator determines a primary prize that a player 108 will receive for a target strike, which may include a null prize, a fixed prize, or a progressive prize. In this manner, the primary prize calculator determines a primary game result. Included within the determination of the primary game result is the determination of a secondary game result.

Next, the secondary prize calculator may determine the result of a different game of chance. The secondary prize calculator engages upon a triggering event, such as the award of a primary prize for a target hit. The triggering event may also include a random selection event or a scheduled routine event. The game of chance may be specified from one or more of a primary game result and a player selection. Each game of chance has an associated pay-table determined by the target struck and/or the primary game result. The game of chance result is determined through operation of a RNG one or more times. The particular pay-table employed in a game of chance is a predetermined relationship between various prize possibilities and the associated probabilities of those results occurring.

The final stage of a game session facilitated by the dual matrix wagering system 900 is a game result animation and prize award. The animation and prize award include announcing and presenting to the player 108 in an entertaining manner the primary and secondary prizes. The animation and prize award also include updating the player's account status to reflect any winnings that the player 108 may have achieved.

FIGS. 19 through 22 show a variety of different games and prize redemptions associated with each game embodiment. In some embodiments, wagering games may be funded by the act of hitting a ball 106 or paying a time-based fee for game play. In those cases, the prizes may be a function of what target 286 is hit and the results of a game of chance which is initiated by the target hit.

If regulations specify that no skill is permitted to impact the result when a wager is placed and/or to guarantee that a misread ball ID at a target 286 does not penalize a player 108 financially, a positive ID mechanism embodiment may be used which requires that: (a) a charge for a player to pay for a wager only occurs AFTER the ball has been hit; (b) the ball has entered a target area 1400 or 1402; and (c) the ball has been identified and linked to a ball that has been previously associated with a particular player 108. In this manner, a player 108 will never encounter a situation where a golf ball is hit and paid for and a corresponding target hit is not properly associated with the play. The positive ID mechanism provides additional value by removing an element of skill in the game play. Thus, whether a golfer is a beginner or professional, the player only pays are for balls that enter the target.

In various embodiments, the game of chance play mechanism engages after a target hit. In these embodiments, a randomized process determines various prize levels after a target hit. The randomization process can be of an electronic or mechanical nature.

Where the randomization event is purely electronic, then the server 918 or the PIU 910 generate a game and an associated animation for presentation on one or more electronic displays that may be associated with the PIU 910. The form of the electronic animation can be of any variety. It may be an electronic representation of a slot machine, or a horse race, a wheel spin, a simulation of any wagering game, or any other imagined way of presenting the prize. One or more randomization events will occur in the system and, based upon a wager amount, a resulting prize level will be determined and an animation will be presented to the player at the PIU 910. The game content, or portions of it, may also be presented on other electronic displays throughout the facility. For instance, if the game played involves a large bonus prize, it may be of interest to other players that a ball hit by a player 108 in the hitting bays or driving spaces 110 has won the prize, and that information can be presented to multiple players on a centrally located display and/or on displays in the other hitting bays or driving spaces 110 where other players and spectators are located and can view them.

Additionally, some regulations may support wagering based on pure skill based games. Furthermore, some regulations may support wagering based on a combination of skill based games and no-skill based games, i.e. games of chance. The amount of skill and the amount of chance for each game will depend on game design objectives and constraints. The games of skill and games of chance may further be embodied as group games, individual games, or a combination thereof, e.g. a progressive prize. A unique aspect of some illustrative embodiments is the integration of a game of skill, such as golf, with a game of chance.

In one embodiment, a group game may include a number of steps, in which a group of N players 108 enroll in a game session for a fee. Each game has a fixed number of balls, with each player 108 assigned to hit m balls 106. Once all balls have been hit, a score and/or randomized prize are determined by the control unit 112 or the server 918 for each ball landing in a target 286. Throughout play, players 108 can check progress on displays 940. Actual game play steps may include, in addition to hitting balls, a wheel spin or other game for a progressive jackpot prize.

In another embodiment, a n-balls-in-order game includes a player 108 attempting to hit targets 286 in a particular order. More specifically, a player 108 hits balls 106 and attempts to hit targets in a numerical order, e.g. 1, 2, 3, 4, . . . n. The prize value is determined from the number of targets 286 hit and those targets 286 hit in the correct order. For example, hitting exemplary targets 1 through 3 in order wins prize value A, and hitting exemplary targets 1 through 5 wins a bigger prize, value B. Play status is always indicated to the player 108 on one or more video screens, including the display 940 on the PIU 910. When a predetermined maximum number of consecutive targets 286 or target areas 1400 or 1402 are hit, the prize may include a game of chance with a wheel-spin or other game representation which provides a randomized chance to win a progressive prize.

It is to be understood that the detailed description of the illustrative embodiments are provided for illustrative purposes only. Thus, the degree of software modularity for the transactional system and method presented above may evolve to benefit from the improved performance and lower cost of the future hardware components that meet the system and method requirements presented. The scope of the claims is not limited to these specific embodiments or examples. Therefore, various process limitations, elements, details, and uses may differ from those just described, or be expanded on or implemented using technologies not yet commercially viable, and yet still be within the inventive concepts of the present disclosure. The scope of the invention is determined by the following claims and their legal equivalents.

What is claimed is:

1. A dual matrix wagering system, the system including:

a ball;

a driving space;

a target including a first target area and a second target area;

a dual matrix tracking apparatus including, a first shadow detection array communicatively coupled to a control unit, the first shadow detection array including a first plurality of sensors configured to detect at least a first shadow detection location associated with a first plurality of projectile shadows, the first shadow detection array further associated with a first timestamp, wherein the first shadow detection array communicates the first shadow detection location and associated first timestamp to the control unit, a second shadow detection array communicatively coupled to the control unit, the second shadow detection array including a second plurality of sensors configured to detect at least a second shadow detection location associated with a second plurality of projectile shadows, the second shadow detection location further associated with a second timestamp, wherein the second shadow detection array communicates the second shadow detection location and associated second timestamp to the control unit, the control unit configured to determine a first projectile position from at least the first shadow detection location;

a first target prize corresponding to striking the first target area, wherein awarding the first target prize triggers a first random game event having an associated first pay-table and corresponding first random prize that is awarded according to the first pay-table;

a second target prize corresponding to striking the second target area, wherein awarding the second target prize triggers a second random game event having a second pay-table and corresponding second random prize that is awarded according to the second pay-table;

wherein the first pay-table is different from the second pay-table, and wherein the first target prize is different from the second target prize.

2. The dual matrix wagering system of claim 1 wherein the control unit is configured to determine a second projectile position from at least the second shadow detection location.

3. The dual matrix wagering system of claim 2 further comprising a projectile flight path determined from the first projectile position and the second projectile position.

4. The dual matrix wagering system of claim 1 further comprising a projectile flight path determined from the first projectile position.

5. The dual matrix wagering system of claim 1 wherein the first shadow detection array includes a first plurality of light emitters and the first plurality of sensors include a first plurality of shadow sensors; and wherein the second shadow detection array includes a second plurality of light emitters and the second plurality of sensors include a second plurality of shadow sensors.

6. The dual matrix wagering system of claim 5 wherein the first plurality of light emitters and first plurality of shadow sensors are disposed about a first plane;

wherein the second plurality of light emitters and second plurality of shadow sensors are disposed about a second plane; and wherein the first plane is parallel to the second plane.

7. The dual matrix wagering system of claim 6 wherein the first plurality of light emitters are configured to emit light when a projectile enters the first plane; and wherein the second plurality of light emitters are configured to emit light when a projectile enters the second plane.

* * * * *